US009176407B2

(12) United States Patent
Hasegawa et al.

(10) Patent No.: US 9,176,407 B2
(45) Date of Patent: Nov. 3, 2015

(54) TONER AND METHOD FOR MANUFACTURING TONER PARTICLES

(71) Applicant: CANON KABUSHIKI KAISHA, Tokyo (JP)

(72) Inventors: Yuki Hasegawa, Yokohama (JP); Yasuaki Murai, Kawasaki (JP); Masatake Tanaka, Yokohama (JP); Takayuki Toyoda, Yokohama (JP); Masashi Kawamura, Yokohama (JP); Waka Hasegawa, Tokyo (JP); Masashi Hirose, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/357,163

(22) PCT Filed: Nov. 8, 2012

(86) PCT No.: PCT/JP2012/079591
§ 371 (c)(1),
(2) Date: May 8, 2014

(87) PCT Pub. No.: WO2013/069816
PCT Pub. Date: May 16, 2013

(65) Prior Publication Data

US 2014/0308610 A1 Oct. 16, 2014

(30) Foreign Application Priority Data

Nov. 10, 2011 (JP) ..... 2011-246928

(51) Int. Cl.
*G03G 9/087* (2006.01)
*G03G 9/09* (2006.01)
*G03G 9/08* (2006.01)

(52) U.S. Cl.
CPC ..... *G03G 9/091* (2013.01); *G03G 9/0806* (2013.01); *G03G 9/08755* (2013.01); *G03G 9/08768* (2013.01)

(58) Field of Classification Search
CPC ..... G03G 9/08791; G03G 9/08784; G03G 9/08755; G03G 9/0804; G03G 9/091
See application file for complete search history.

(56) References Cited

U.S. PATENT DOCUMENTS 8,377,616 B2 * 2/2013 Tani et al. ..... 430/108.23

FOREIGN PATENT DOCUMENTS

| | | | |
|---|---|---|---|
| JP | 3917764 | B2 | 5/2007 |
| JP | 3984840 | B2 | 10/2007 |
| JP | 2010-152208 | A | 7/2010 |
| WO | 99-42532 | A1 | 8/1999 |
| WO | 02/44283 | A2 | 6/2002 |

* cited by examiner

*Primary Examiner* — Peter Vajda
(74) *Attorney, Agent, or Firm* — Canon U.S.A. Inc., IP Division

(57) ABSTRACT

The present invention provides a toner that contains an azo pigment well-dispersed in a binder resin and has a satisfactory color tone.
The toner contains toner particles each containing a binder resin and a colorant. Each of the toner particles contains a compound having a polyester moiety and a bisazo structure moiety. The colorant is the azo pigment.

9 Claims, 2 Drawing Sheets

TONER AND METHOD FOR MANUFACTURING TONER PARTICLES

TECHNICAL FIELD

The present invention relates to a toner for use in electrophotography, electrostatic recording, electrostatic printing, or toner jet recording, and a method for manufacturing toner particles of the toner.

BACKGROUND ART

PTL 1 discloses the use of an azo pigment as a toner colorant. In order to improve spectral characteristics, such as tinting strength and transparency, a pigment must be finely dispersed in a toner binder resin or a polymerizable monomer. However, a reduction in the size of azo pigment particles generally results in an increase in the growth or transformation of crystals caused by thermal history or contact with a solvent in a dispersion process and subsequent processes. This results in a decrease in the tinting strength and transparency of the toner. Furthermore, in a toner manufacturing process using an azo pigment, particularly utilizing a polymerization method, the reaggregation of fine azo pigment particles may cause an increase in the viscosity of the pigment dispersion.

Various pigment dispersants have been proposed in order to solve these problems. PTL 2 discloses a polymer dispersant in which a moiety having a high affinity for an azo pigment colorant is covalently bonded to an oligomer or polymer moiety having a high affinity for a solvent and a binder resin. PTL 3 discloses the use of a comb polymer dispersant having an acidic or basic portion known as Solsperse (registered trademark).

CITATION LIST

Patent Literature

PTL 1 Japanese Patent No. 3917764

PTL 2 Japanese Patent No. 3984840

PTL 3 International Publication WO 99-42532

SUMMARY OF INVENTION

However, the pigment dispersants disclosed in PTL 2 and PTL 3 have insufficient affinity for an azo pigment, provide insufficient pigment dispersion, and therefore cannot achieve the toner color tone required for high-resolution images. Furthermore, when a toner is manufactured by a polymerization method using these pigment dispersants and an azo pigment, a reduction in the size of the azo pigment particles may cause an increase in the viscosity of the pigment dispersion in a pigment dispersion process.

The present invention provides a toner with which these problems can be solved. More specifically, the present invention provides a toner that contains an azo pigment well dispersed in a binder resin and has a satisfactory color tone and a method for manufacturing toner particles of the toner.

The present invention relates to a toner that contains toner particles each containing a binder resin and a colorant. Each of the toner particles contains a compound having a polyester moiety and a bisazo structure moiety represented by the following formula (1) or (2). The colorant is an azo pigment.

[Chem. 1]

Formula (1)

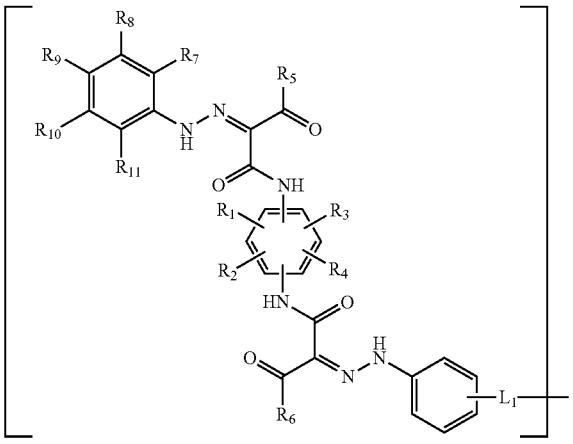

Formula (2)

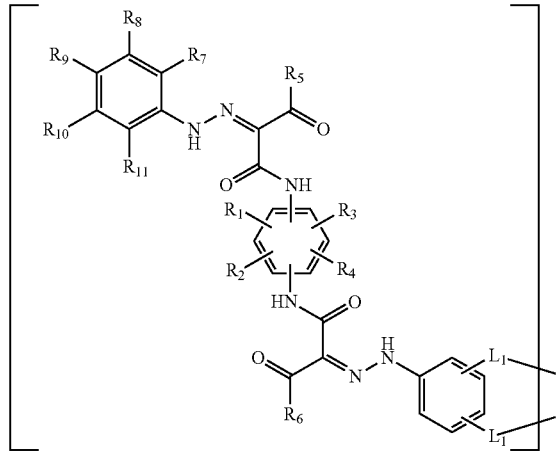

In the formulae (1) and (2), $R_1$ to $R_4$ independently denote a hydrogen atom or a halogen atom, $R_5$ and $R_6$ independently denote an alkyl group having 1 to 6 carbon atoms or a phenyl group, $R_7$ to $R_{11}$ independently denote a hydrogen atom, a $COOR_{12}$ group, or a $CONR_{13}R_{14}$ group, provided that at least one of $R_7$ to $R_{11}$ denotes the $COOR_{12}$ group or the $CONR_{13}R_{14}$ group, $R_{12}$ to $R_{14}$ independently denote a hydrogen atom or an alkyl group having 1 to 3 carbon atoms, and $L_1$ denotes a divalent linking group to be bonded to the polyester moiety.

The present invention also relates to a method for manufacturing toner particles of the toner.

Further features of the present invention will become apparent from the following description of exemplary embodiments with reference to the attached drawings.

DESCRIPTION OF EMBODIMENTS

Figure 1:
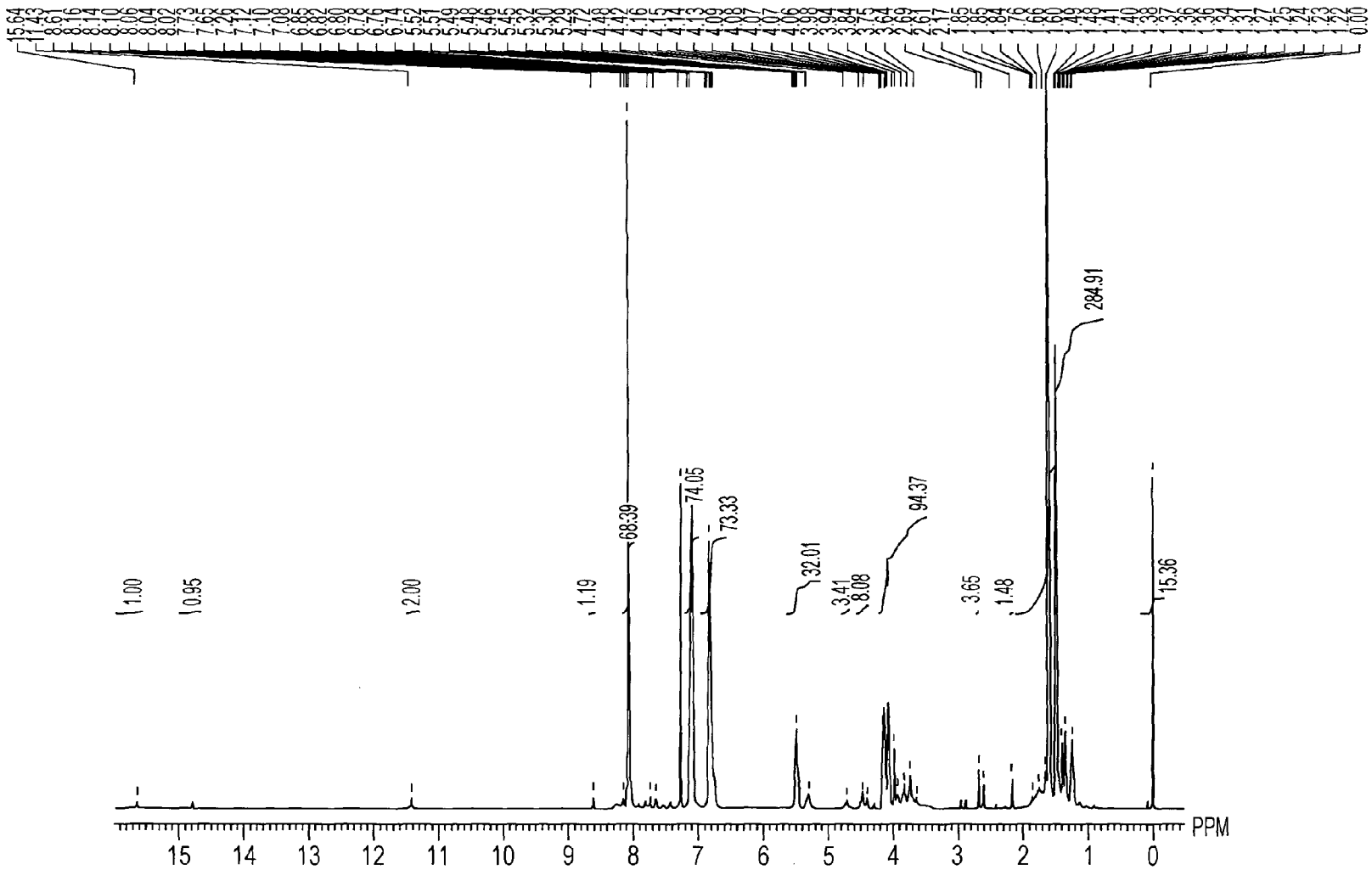
FIG. 1 is a $^1$H NMR spectrum of a polyester (35) having a bisazo dye skeleton measured at 400 MHz in $CDCl_3$ at room temperature.

The present invention will be described in detail in the following embodiments. A compound having a bisazo structure moiety represented by the formula (1) or (2) and a polyester moiety is hereinafter referred to as a "polyester having a bisazo dye skeleton". The polyester moiety refers to a polyester resin moiety other than the bisazo structure moiety in the compound. A toner according to an embodiment of the present invention will be described below.

A toner according to an embodiment of the present invention contains toner particles, each of which contains a binder resin, a compound having a polyester moiety and a bisazo structure moiety represented by the following formula (1) or (2), and an azo pigment colorant.

[Chem. 1]

Formula (1)

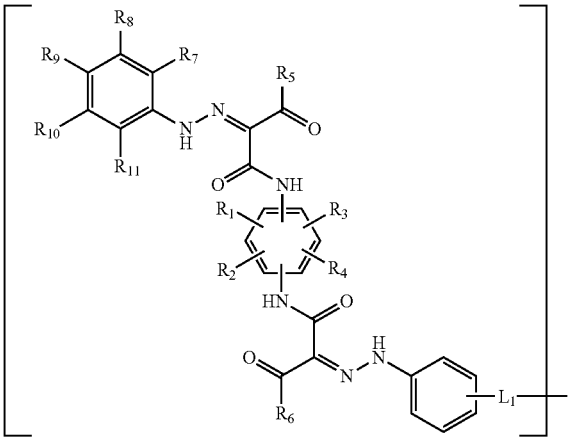

Formula (2)

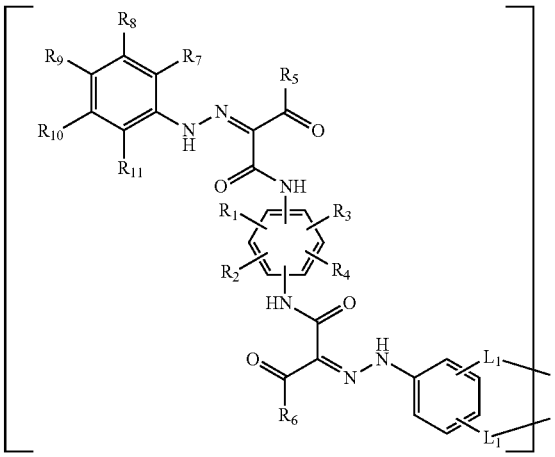

In the formulae (1) and (2), $R_1$ to $R_4$ independently denote a hydrogen atom or a halogen atom, $R_5$ and $R_6$ independently denote an alkyl group having 1 to 6 carbon atoms or a phenyl group, $R_7$ to $R_{11}$ independently denote a hydrogen atom, a $COOR_{12}$ group, or a $CONR_{13}R_{14}$ group, provided that at least one of $R_7$ to $R_{11}$ denotes the $COOR_{12}$ group or the $CONR_{13}R_{14}$ group, $R_{12}$ to $R_{14}$ independently denote a hydrogen atom or an alkyl group having 1 to 3 carbon atoms, and $L_1$ denotes a divalent linking group to be bonded to the polyester moiety.

The components of a polyester having the bisazo dye skeleton represented by the formula (1) or (2) will be described below. A polyester having a bisazo dye skeleton includes the bisazo structure moiety represented by the formula (1) or (2) having a high affinity for an azo pigment and a polyester moiety having a high affinity for a water-insoluble solvent. Thus, the polyester has a high affinity for a water-insoluble solvent, a polymerizable monomer, and a toner binder resin, as well as an azo pigment, particularly an acetoacetanilide pigment. Use of such a polyester having a bisazo dye skeleton as a toner pigment dispersant allows an azo pigment, such as C.I. Pigment Yellow 155, to be well dispersed in a binder resin, thereby providing a toner having a satisfactory color tone. In the manufacture of a toner, such a polyester can improve the dispersion stability of an azo pigment in a water-insoluble solvent and prevent an increase in the viscosity of the pigment dispersion.

Examples of a halogen atom in $R_1$ to $R_4$ include, but are not limited to, a fluorine atom, a chlorine atom, a bromine atom, and an iodine atom.

$R_1$ to $R_4$ may be selected from the substituents described above and a hydrogen atom. $R_1$ to $R_4$ may be a hydrogen atom in terms of affinity for a pigment.

The positions of $R_1$ to $R_4$ and two acylacetamide groups may be such that the acylacetamide groups are located at the o-, m-, or p-position to each other. The affinity for a pigment is almost independent of the substitution position. A compound having the acylacetamide groups in the p-position to each other can be easily manufactured.

Examples of an alkyl group in $R_5$ and $R_6$ include, but are not limited to, linear, branched, and cyclic alkyl groups having 1 to 6 carbon atoms, such as a methyl group, an ethyl group, a n-propyl group, a n-butyl group, a n-pentyl group, a n-hexyl group, an isopropyl group, an isobutyl group, a sec-butyl group, a tert-butyl group, and a cyclohexyl group.

A substituent in $R_5$ and $R_6$ may be further substituted by an additional substituent, provided that the additional substituent does not significantly lower the affinity for a pigment. Examples of the additional substituent include, but are not limited to, a halogen atom, a nitro group, an amino group, a hydroxy group, a cyano group, and a trifluoromethyl group.

$R_5$ and $R_6$ may be a methyl group in terms of affinity for a pigment.

$L_1$ in the formulae (1) and (2) denotes a divalent linking group for connecting the bisazo dye skeleton to the polyester.

The bisazo dye skeleton is connected to the polyester through one $L_1$ in the formula (1) or two $L_1$'s in the formula (2).

$L_1$ may be any divalent linking group. In terms of the ease of manufacture, $L_1$ may be a carboxylate bond, a carboxylic acid amide bond, or a sulfonate bond.

In terms of affinity for a pigment, $L_1$ may be located at a 4-position relative to the hydrazo group.

$R_7$ to $R_{11}$ denotes a hydrogen atom, a $COOR_{12}$ group, or a $CONR_{13}R_{14}$ group, provided that at least one of $R_7$ to $R_{11}$ denotes the $COOR_{12}$ group or the $CONR_{10}R_{14}$ group. In terms of affinity for an azo pigment, $R_7$ and $R_{10}$ denote a $COOR_{12}$ group, and $R_8$, $R_9$, and $R_{11}$ denote a hydrogen atom. Examples of an alkyl group in $R_{12}$ to $R_{14}$ include, but are not limited to, a methyl group, an ethyl group, a n-propyl group, and an isopropyl group.

$R_{12}$ in a $COOR_{12}$ group may be a methyl group, $R_{13}$ in a $CONR_{13}R_{14}$ group may be a methyl group, and $R_{14}$ in a $CONR_{13}R_{14}$ group may be a methyl group or a hydrogen atom.

A bisazo dye skeleton moiety having the following formula (7) can contribute to a high affinity for a pigment.

[Chem. 2]

Formula (7)

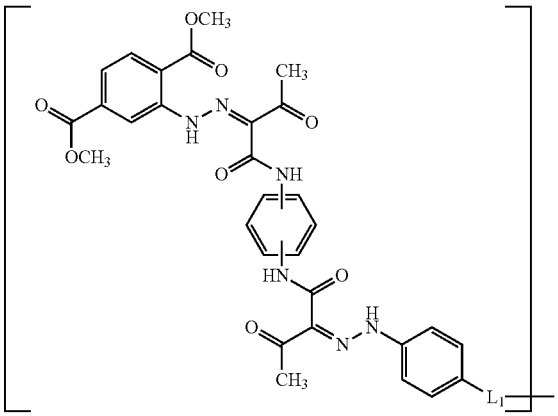

The polyester moiety will be described below.

The polyester moiety may have a linear, branched, or cross-linked structure.

In terms of affinity for a water-insoluble solvent, the polyester moiety may be a polycondensation polymer of a dicarboxylic acid and a diol or a hydroxy acid polycondensation polymer.

A dicarboxylic acid monomer for constituting the polyester moiety may have an alkylene group, an alkenylene group, or an arylene group each having a carboxy group at both ends. Examples of the alkylene group include, but are not limited to, linear, branched, and cyclic alkylene groups, such as a methylene group, an ethylene group, a trimethylene group, a propylene group, a tetramethylene group, a hexamethylene group, a neopentylene group, a heptamethylene group, an octamethylene group, a nonamethylene group, a decamethylene group, an undecamethylene group, a dodecamethylene group, a 1,3-cyclopentylene group, a 1,3-cyclohexylene group, and a 1,4-cyclohexylene group. Examples of the alkenylene group include, but are not limited to, a vinylene group, a propenylene group, and a 2-butenylene group. Examples of the arylene group include, but are not limited to, a 1,4-phenylene group, a 1,3-phenylene group, a 1,2-phenylene group, a 2,6-naphthylene group, a 2,7-naphthylene group, and a 4,4'-biphenylene group.

These alkylene group, alkenylene group, and arylene group may be substituted by a substituent, provided that the affinity for a water-insoluble solvent is not significantly lowered. Examples of the substituent include, but are not limited to, a methyl group, halogen atoms, a carboxy group, a trifluoromethyl group, and combinations thereof.

In terms of affinity for a nonpolar solvent, the dicarboxylic acid monomer may be an alkylene group having six or more carbon atoms or a phenylene group each having a carboxy group at both ends.

In terms of affinity for a water-insoluble solvent, a diol monomer for constituting the polyester moiety may have an alkylene group or a phenylene group each having a hydroxy group at both ends. The diol monomer for constituting the polyester moiety may be an ethylene oxide additive of bisphenol A or a propylene oxide adduct of bisphenol A. The additive number of ethylene oxides or propylene oxides may be in the range of 2 to 10.

Examples of the alkylene group include, but are not limited to, linear, branched, and cyclic alkylene groups, such as a methylene group, an ethylene group, a trimethylene group, a propylene group, a tetramethylene group, a hexamethylene group, a neopentylene group, a heptamethylene group, an octamethylene group, a nonamethylene group, a decamethylene group, an undecamethylene group, a dodecamethylene group, a 1,3-cyclopentylene group, a 1,3-cyclohexylene group, and a 1,4-cyclohexylene group. The alkylene group may be an alkylene group having six or more carbon atoms.

Examples of the phenylene group include, but are not limited to, a 1,4-phenylene group, a 1,3-phenylene group, and a 1,2-phenylene group.

The alkylene group or the phenylene group may be further substituted by a substituent, provided that the affinity for a water-insoluble solvent is not significantly lowered. Examples of the substituent include, but are not limited to, a methyl group, alkoxy groups, a hydroxy group, halogen atoms, and combinations thereof.

A hydroxy acid monomer for constituting the polyester moiety may have an alkylene group or an alkenylene group each having a hydroxy group or a carboxy group at both ends.

Examples of the alkylene group include, but are not limited to, linear, branched, and cyclic alkylene groups, such as a methylene group, an ethylene group, a trimethylene group, a propylene group, a tetramethylene group, a hexamethylene group, a neopentylene group, a heptamethylene group, an octamethylene group, a nonamethylene group, a decamethylene group, an undecamethylene group, a dodecamethylene group, and a 1,4-cyclohexylene group.

Examples of the alkenylene group include, but are not limited to, a vinylene group, a propenylene group, a butenylene group, a butadienylene group, a pentenylene group, a hexenylene group, a hexadienylene group, a heptenylene group, an octanylene group, a decenylene group, an octadecenylene group, an eicosenylene group, and a triacontenylene group. These alkenylene groups may have a linear, branched, or cyclic structure. The alkenylene group may have at least one double bond at any position.

The alkylene group or the alkenylene group may be further substituted by a substituent, provided that the affinity for a water-insoluble solvent is not significantly lowered. Examples of the substituent include, but are not limited to, alkyl groups, alkoxy groups, a hydroxy group, halogen atoms, and combinations thereof.

In terms of affinity for a nonpolar solvent, the alkylene group or the alkenylene group may be an alkylene group or an alkenylene group each having six or more carbon atoms.

In order to improve pigment dispersibility, the polyester having a bisazo dye skeleton may have a number-average molecular weight (Mn) of 500 or more. Although the polyester having a higher molecular weight can more improve pigment dispersibility, an excessively high molecular weight unfavorably results in a low affinity for a water-insoluble solvent. The polyester resin may therefore have a number-average molecular weight (Mn) of 200,000 or less. In consideration of the ease of manufacture, the polyester having a bisazo dye skeleton may have a number-average molecular weight in the range of 2000 to 20000.

The bisazo structure moiety having the formula (1) has tautomers having the following formulae (9) and (10).

These tautomers are also within the scope of the present invention.

[Chem. 3.]
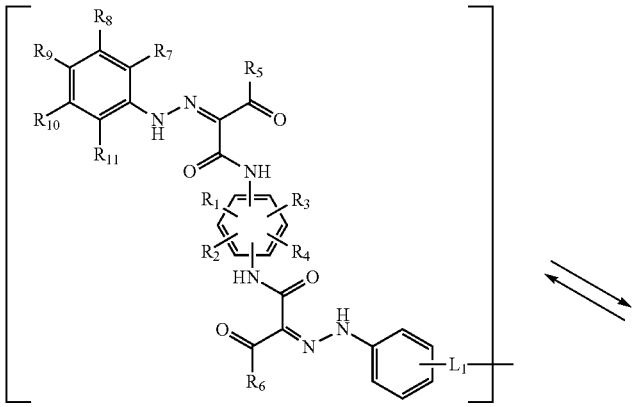
Formula (1)
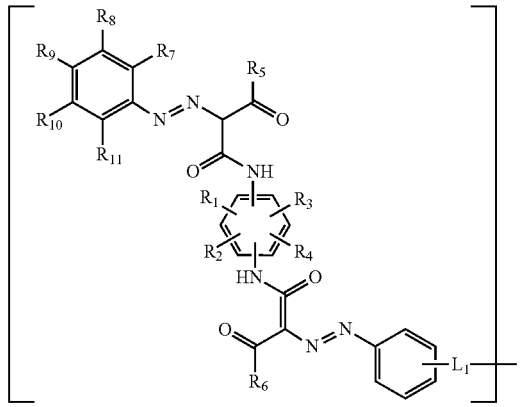
Formula (9)
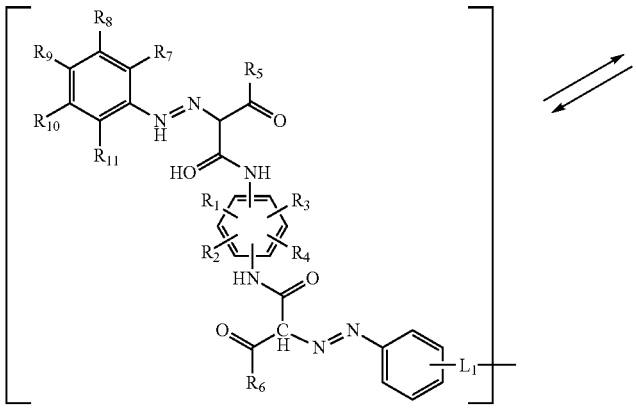
Formula (10)
In the formulae (9) and (10), $L_1$ and $R_1$ to $R_{11}$ are the same as $L_1$ and $R_1$ to $R_{11}$ in the formula (1).
The bisazo structure moiety having the formula (2) has tautomers having the following formulae (11) and (12). These tautomers are also within the scope of the present invention.

[Chem. 4]
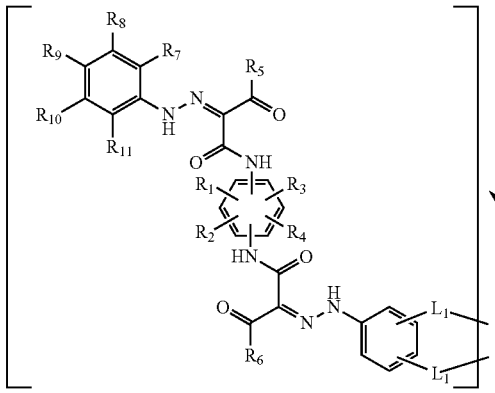
Formula (2)
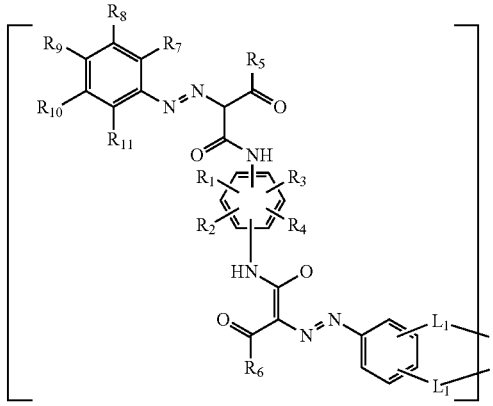
Formula (11)
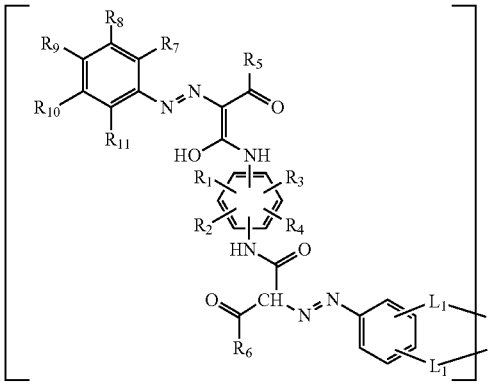
Formula (12)
In the formulae (11) and (12), $L_1$ and $R_1$ to $R_{11}$ are the same as $L_1$ and $R_1$ to $R_{11}$ in the formula (2).
The bisazo structure moiety having the formula (1) or (2) can be synthesized by a known method. The following is an example of a synthesis scheme up to the production of an azo dye intermediate (20).
[Chem. 5]
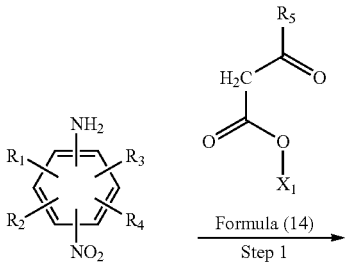
Formula (13)
-continued
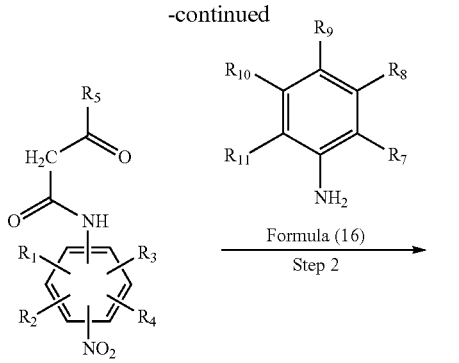
Formula (15)
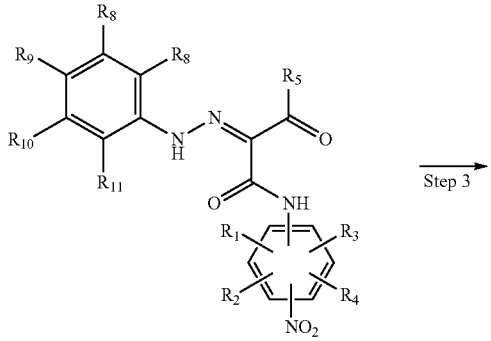
Formula (17)

-continued

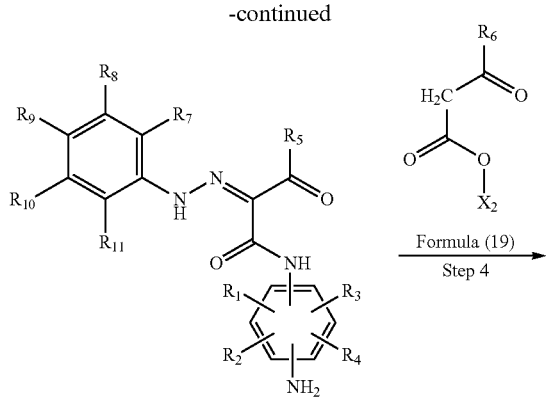

Formula (18)

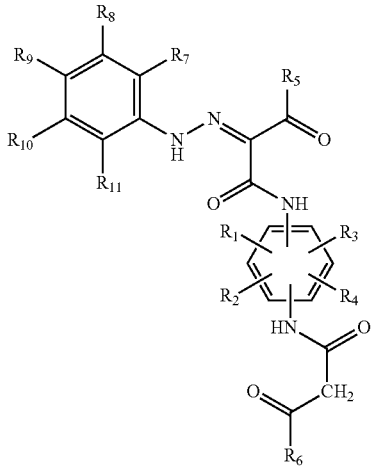

Formula (20)

$R_1$ to $R_{11}$ in the formulae (13) to (20) are the same as in the formula (1) or (2). $X_1$ and $X_2$ are leaving groups.

This scheme includes a step 1 of amidation between a nitroaniline derivative having the formula (13) and an acetoacetic acid analog having the formula (14) to synthesize an intermediate (15), which is an acetoacetanilide analog, a step 2 of diazocoupling between the intermediate (15) and an aniline derivative (16) to synthesize an azo compound (17), a step 3 of reducing a nitro group of the azo compound (17) to synthesize an intermediate (18), which is an aniline analog, and a step 4 of amidation between the intermediate (18) and an acetoacetic acid analog having the formula (19) to synthesize an azo dye intermediate (20).

First, the step 1 will be described below. A known method may be used in the step 1 (for example, Datta E. Ponde, et al., "The Journal of Organic Chemistry", (the U.S.A.), American Chemical Society, 1998, vol. 63, No. 4, pp. 1058-1063). In the case that $R_5$ in the formula (15) is a methyl group, the acetoacetic acid analog (14) may be replaced with diketene (for example, Kiran Kumar Solingapuram Sai, et al., "The Journal of Organic Chemistry", (the U.S.A.), American Chemical Society, 2007, vol. 72, No. 25, pp. 9761-9764).

The nitroaniline derivative (13) and the acetoacetic acid analog (14) may be commercially available or may be synthesized by a known method.

The step 1 may be performed in the absence of a solvent or in the presence of a solvent in order to prevent rapid progress of the reaction. The solvent may be any solvent that does not inhibit the reaction. Examples of the solvent include, but are not limited to, alcohols, such as methanol, ethanol, and propanol; esters, such as methyl acetate, ethyl acetate, and propyl acetate; ethers, such as diethyl ether, tetrahydrofuran, and dioxane; hydrocarbons, such as benzene, toluene, xylene, hexane, and heptane; halogen-containing hydrocarbons, such as dichloromethane, dichloroethane, and chloroform; amides, such as N,N-dimethylformamide and N,N-dimethylimidazolidinone; nitriles, such as acetonitrile and propionitrile; acids, such as formic acid, acetic acid, and propionic acid; and water. These solvents may be used alone or in combination. For a mixed solvent, the mixing ratio may be determined in accordance with the solubility of the solute. The amount of solvent to be used may be appropriately determined and, in terms of reaction rate, may be 1.0 to 20 times the mass of the compound having the formula (13).

The step 1 is generally performed at a temperature in the range of 0° C. to 250° C. and is generally completed within 24 hours.

The step 2 will be described below. A known method can be used in the step 2. More specifically, for example, the following method can be used. First, the aniline derivative (16) is allowed to react with a diazotizing agent, such as sodium nitrite or nitrosylsulfuric acid, in the presence of an inorganic acid, such as hydrochloric acid or sulfuric acid, in a methanol solvent to synthesize a corresponding diazonium salt. The diazonium salt is coupled with the intermediate (15) to synthesize the azo compound (17).

The aniline derivative (16) may be commercially available or may be synthesized by a known method.

The step 2 may be performed in the absence of a solvent or in the presence of a solvent in order to prevent rapid progress of the reaction. The solvent may be one of those described for the step 1. The amount of solvent to be used may be appropriately determined and, in terms of reaction rate, may be 1.0 to 20 times the mass of the compound having the formula (16).

The step 2 is generally performed at a temperature in the range of −50° C. to 100° C. and is generally completed within 24 hours.

The step 3 will be described below. A known method can be used in the step 3. For example, a method using a metallic compound can be found in "Jikken Kagaku Koza (lecture on experimental chemistry)", Maruzen Co., Ltd., first edition, vol. 17-2, pp. 162-179. A catalytic hydrogenation method can be found in "Jikken Kagaku Koza (lecture on experimental chemistry)", Maruzen Co., Ltd., first edition, vol. 15, pp. 390-448 or International Publication WO 2009-060886.

The step 3 may be performed in the absence of a solvent or in the presence of a solvent in order to prevent rapid progress of the reaction. The solvent may be one of those described for the step 1. The amount of solvent to be used may be appropriately determined in accordance with the solubility of the solute and, in terms of reaction rate, may be 1.0 to 20 times the mass of the compound having the formula (17). The step 3 is generally performed at a temperature in the range of 0° C. to 250° C. and is generally completed within 24 hours.

The step 4 will be described below. In the step 4, the azo dye intermediate (20) is synthesized by the method described in the step 1.

The polyester having the bisazo dye skeleton represented by the formula (1) or (2) may be produced from the azo dye intermediate (20) by the following methods (i) to (iii).

The method (i) will be described in detail below.

Method (i)

[Chem. 6]

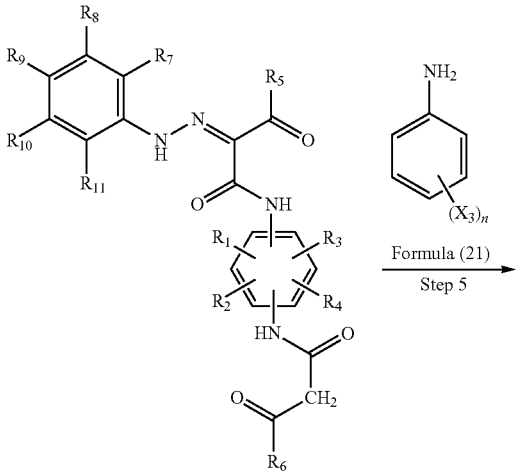

Formula (20)

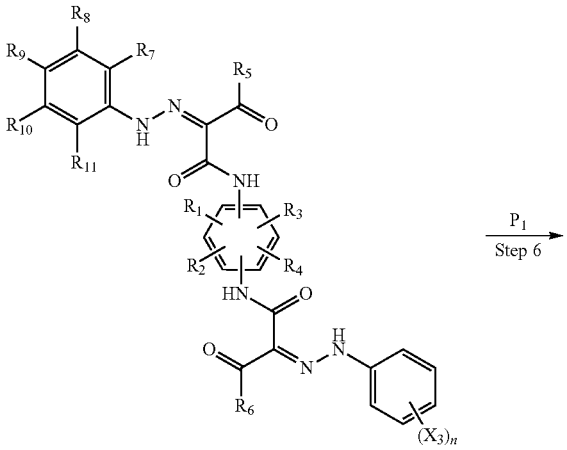

Formula (22)

Polyester having bis-azo dye skeleton represented by formula (1) or (2)

In the formulae (20) to (22), $R_1$ to $R_{11}$ are the same as $R_1$ to $R_{11}$ in the formula (1) or (2). n is an integer of 1 or 2. $X_3$ denotes a substituent that can react to form a linking group $L_1$ in the formula (1) or (2). $P_1$ denotes a polyester resin.

The scheme described above includes a step 5 of diazocoupling between the azo dye intermediate (20) and an aniline derivative (21) to synthesize a bisazo compound (22) and a step 6 of esterification or amidation between the bisazo compound (22) and the polyester resin $P_1$ synthesized in advance to synthesize a polyester having the bisazo dye skeleton represented by the formula (1) or (2).

First, the step 5 will be described below. In the step 5, the bisazo compound (22) can be synthesized by the method described in the step 2.

The aniline derivative (21) may be commercially available or may be synthesized by a known method.

The step 6 will be described below. A known method can be used in the step 6. More specifically, for example, a polyester having the bisazo dye skeleton represented by the formula (1) or (2) in which the linking group $L_1$ is a carboxylate group may be synthesized using a polyester resin $P_1$ having a carboxy group and the aniline derivative (21) in which $X_3$ has a hydroxy group. A polyester having the bisazo dye skeleton represented by the formula (1) or (2) in which the linking group $L_1$ is a sulfonate group may be synthesized using a polyester resin $P_1$ having a hydroxy group and the aniline derivative (21) in which $X_3$ has a sulfo group. A polyester having the bisazo dye skeleton represented by the formula (1) or (2) in which the linking group $L_1$ is a carboxylic acid amide group may be synthesized using a polyester resin $P_1$ having a carboxy group and the aniline derivative (21) in which $X_3$ has an amino group. Specific examples of the known method include, but are not limited to, a method using a dehydrating and condensing agent, for example, 1-ethyl-3-(3-dimethylaminopropyl)carbodiimide hydrochloride (for example, Melvin S. Newman, et al., "Journal of Organic Chemistry", (the U.S.A.), American Chemical Society, 1961, vol. 26, No. 7, pp. 2525-2528) and a Schotten-Baumann method (for example, Norman O. V. Sonntag, "Chemical Reviews", (the U.S.A.), American Chemical Society, 1953, vol. 52, No. 2, pp. 237-416).

The step 6 may be performed in the absence of a solvent or in the presence of a solvent in order to prevent rapid progress of the reaction. The solvent may be any solvent that does not inhibit the reaction. Examples of the solvent include, but are not limited to, ethers, such as diethyl ether, tetrahydrofuran, and dioxane; hydrocarbons, such as benzene, toluene, xylene, hexane, and heptane; halogen-containing hydrocarbons, such as dichloromethane, dichloroethane, and chloroform; amides, such as N,N-dimethylformamide and N,N-dimethylimidazolidinone; and nitriles, such as acetonitrile and propionitrile. These solvents may be used alone or in combination. For a mixed solvent, the mixing ratio may be determined in accordance with the solubility of the solute. The amount of solvent to be used may be appropriately determined and, in terms of reaction rate, may be 1.0 to 20 times the mass of the compound having the formula (21).

The step 6 is generally performed at a temperature in the range of 0° C. to 250° C. and is generally completed within 24 hours.

The method (ii) will be described in detail below.

Method (ii)

[Chem. 7]

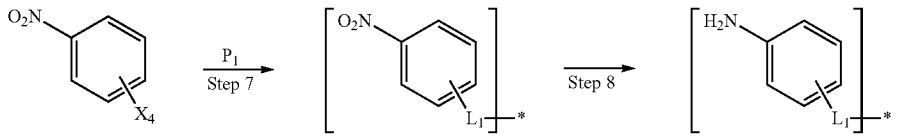

Formula (23) Formula (24) Formula (25)

-continued

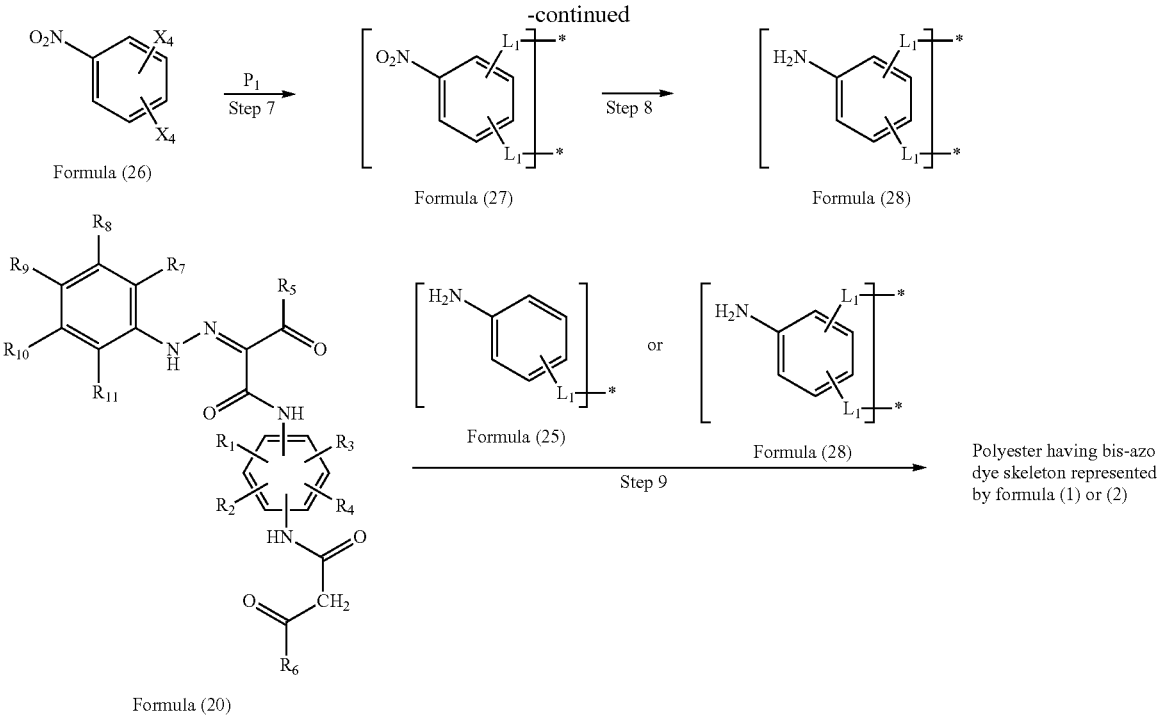

In the formulae (20) and (23) to (28), $L_1$ and $R_1$ to $R_{11}$ are the same as $L_1$ and $R_1$ to $R_{11}$ in the formula (1) or (2). $X_4$ denotes a substituent that can react to form a linking group $L_1$ in the formula (1) or (2). $P_1$ denotes a polyester resin. "*" denotes a linkage between the linking group $L_1$ and the polyester resin.

This scheme includes a step 7 of esterification or amidation between the raw material (23) or (26) and the polyester resin $P_1$ synthesized in advance to synthesize an intermediate (24) or (27), a step 8 of reducing a nitro group in the intermediate (24) or (27) to synthesize an aniline analog intermediate (25) or (28), and a step 9 of diazocoupling between the azo dye intermediate (20) and the aniline analog (25) or (28) to synthesize a polyester having the bisazo dye skeleton represented by the formula (1) or (2).

First, the step 7 will be described below. A known method can be used in the step 7. More specifically, for example, the intermediate (24) or (27) in which the linking group $L_1$ is a carboxylate group can be synthesized using the polyester resin $P_1$ having a hydroxy group and the raw material (23) or (26) in which $X_4$ has a carboxylic acid halide group. Furthermore, the intermediate (24) or (27) in which the linking group $L_1$ is a sulfonate group can be synthesized using the polyester resin $P_1$ having a hydroxy group and the raw material (23) or (26) in which $X_4$ has a sulfonic acid halide group. Specific examples of the known method include, but are not limited to, the Schotten-Baumann method (for example, Norman 0. V. Sonntag, "Chemical Reviews", (the U.S.A.), American Chemical Society, 1953, vol. 52, No. 2, pp. 237-416).

The step 7 may be performed in the absence of a solvent or in the presence of a solvent in order to prevent rapid progress of the reaction. The solvent may be one of those described for the method (i). The amount of solvent to be used may be appropriately determined and, in terms of reaction rate, may be 1.0 to 20 times the mass of the compound having the formula (23) or (26).

The step 7 is generally performed at a temperature in the range of 0° C. to 250° C. and is generally completed within 24 hours.

The raw materials (23) and (26) may be commercially available or may be synthesized by a known method.

The step 8 will be described below. In the step 8, the intermediate (25) or (28) can be synthesized by the method described in the step 3.

The step 9 will be described below. In the step 9, a polyester having the bisazo dye skeleton represented by the formula (1) or (2) can be synthesized by the method described in the step 2.

The method (iii) will be described in detail below.

Method (iii)

[Chem. 8]

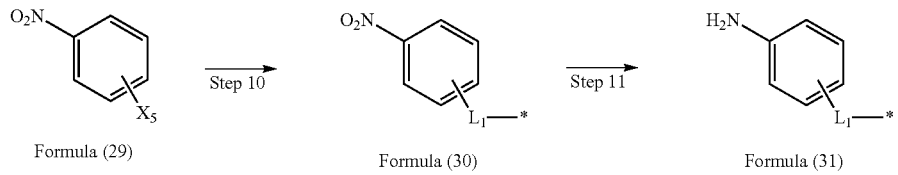

-continued

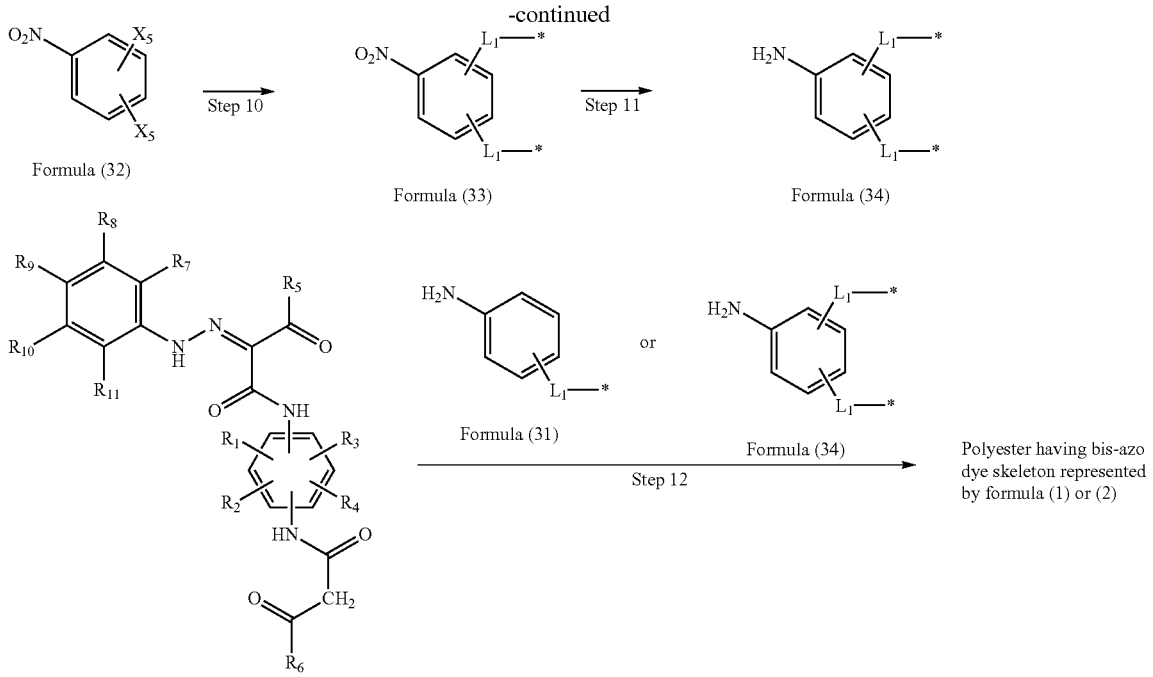

In the formulae (20) and (29) to (34), $L_1$ and $R_1$ to $R_{11}$ are the same as $L_1$ and $R_1$ to $R_{11}$ in the formula (1) or (2). $X_5$ denotes a substituent that can react to form a linking group $L_1$ in the formula (1) or (2). "*" denotes a linkage between the linking group $L_1$ and the polyester resin.

This scheme includes a step 10 of polycondensation or ring-opening polymerization of a monomer for the polyester resin using a raw material (29) or (32) as a polymerization initiator to synthesize an intermediate (30) or (33), a step 11 of reducing a nitro group in the intermediate (30) or (33) to synthesize an aniline analog intermediate (31) or (34), and a step 12 of diazocoupling between the azo dye intermediate (20) and the aniline analog (31) or (34) to synthesize a polyester having the bisazo dye skeleton represented by the formula (1) or (2).

First, the step 10 will be described below. In the step 10, the intermediate (30) or (33) can be synthesized by the addition of the raw material (29) or (32) as a polymerization initiator in polycondensation or ring-opening polymerization of a hydroxycarboxylic acid or lactone.

The step 10 may be performed in the absence of a solvent or in the presence of a solvent in order to prevent rapid progress of the reaction. The solvent may be one of those described for the method (i). The amount of solvent to be used may be appropriately determined and, in terms of reaction rate, may be 1.0 to 20 times the mass of the raw material (29) or (32).

The step 10 is generally performed at a temperature in the range of 0° C. to 250° C. and is generally completed within 24 hours.

In the raw materials (29) and (32), the substituent $X_5$ may have a carboxy group or a hydroxy group.

The raw materials (29) and (32) are commercially available. Examples of the raw materials (29) and (32) include, but are not limited to, 2-nitrophenol, 3-nitrophenol, 4-nitrophenol, 4-nitrocatechol, 2-nitrobenzyl alcohol, 3-nitrobenzyl alcohol, 4-nitrobenzyl alcohol, 4-nitrophenethyl alcohol, 2-nitrobenzoic acid, 3-nitrobenzoic acid, 4-nitrobenzoic acid, 4-nitrophthalic acid, 5-nitroisophthalic acid, and 4-nitrophenylacetic acid.

The molecular weight of the polyester resin can be desirably controlled in accordance with the quantitative ratio of the raw material (29) or (32) to the monomer for the polyester resin.

The step 11 will be described below. In the step 11, the aniline analog (31) or (34) can be synthesized by the method described in the step 3.

The step 12 will be described below. In the step 12, a polyester having the bisazo dye skeleton represented by the formula (1) or (2) can be synthesized by the method described in the step 2.

Common isolation and purification methods for organic compounds may be used for the compounds having the formula (1), (2), (15), (17), (18), (20), (22), (24), (25), (27), (28), (30), (31), (33), and (34). Examples of such isolation and purification methods include, but are not limited to, recrystallization methods and reprecipitation methods using organic solvents and column chromatography using silica gel. These methods may be used alone or in combination to achieve high purity.

The compounds having the formulae (15), (17), (18), (20) and (22) produced through these steps were identified and quantified by nuclear magnetic resonance spectroscopy [ECA-400, manufactured by JEOL Ltd.], ESI-TOF MS (LC/MSD TOF, manufactured by Agilent Technologies), and HPLC analysis [LC-20A, manufactured by Shimadzu Corp.].

The compounds having the formulae (1), (2), (24), (25), (27), (28), (30), (31), (33), and (34) produced through these steps were identified and quantified by high performance GPC [HLC8220GPC, manufactured by Tosoh Corp.], nuclear magnetic resonance spectroscopy [ECA-400, manufactured by JEOL Ltd.], and acid value measurement according to JIS K-0070 [automatic titrator COM-2500, manufactured by Hiranuma Sangyo Co., Ltd.].

A method for producing the polyester resin $P_1$ (polyester moiety) will be described below. The method for producing the polyester resin is not particularly limited and may be a known method. For example, $P_1$ can be produced by polycondensation between a dicarboxylic acid and a diol in a solvent in an inert gas atmosphere.

The polymerization reaction may be promoted with a catalyst. Examples of the catalyst include, but are not limited to, metal catalysts, such as antimony trioxide, di-n-butyltin oxide, tin(II) oxalate, tin di(2-ethylhexanoate), germanium oxide, germanium tetraethoxide, germanium tetrabutoxide, titanium tetraisopropoxide, titanium tetrabutoxide, manganese acetate, zinc di(2-ethylhexanoate), and zinc acetate. The amount of catalyst to be added may be in the range of 0.001% to 0.5% by mole of the polyester.

The solvent for use in the polymerization reaction may be separated from water produced by the polymerization reaction. Examples of the solvent include, but are not limited to, toluene, xylene, mesitylene, 1,2,3,5-tetramethylbenzene, chlorobenzene, 1,2-dichlorobenzene, 1,3-dichlorobenzene, bromobenzene, 1,2-dibromobenzene, 1,3-dibromobenzene, iodobenzene, 1,2-diiodobenzene, diphenyl ether, and dibenzyl ether. These solvents may be used alone or in combination. The mixing ratio of solvents may be appropriately determined.

In order to increase the reaction rate and the degree of polymerization of the polyester resin, the solvent used in the polymerization reaction is refluxed to remove by-products, such as water and alcohol. The polymerization reaction can therefore be performed at approximately the reflux temperature of the solvent.

In the self-condensation-type polymerization reaction, the addition of a monocarboxylic acid or a monoalcohol to the reaction system to esterify an unreacted hydroxy or carboxy group can improve the molecular weight control of the polyester resin and pigment dispersion as a dispersant.

Examples of a monocarboxylic acid that can be used as a reaction inhibitor for a terminal hydroxy group of the polyester resin include, but are not limited to, monovalent carboxylic acids, such as acetic acid, butyric acid, valeric acid, caproic acid, heptanoic acid, caprylic acid, lauric acid, stearic acid, oleic acid, benzoic acid, p-toluic acid, dimethylbenzoic acid, ethylbenzoic acid, cumic acid, and 2,3,4,5-tetramethylbenzoic acid. The monocarboxylic acid may be a branched aliphatic carboxylic acid so as to improve pigment dispersibility.

Examples of a monoalcohol that can be used as a reaction inhibitor for a terminal carboxy group of the polyester resin include, but are not limited to, monohydric alcohols, such as methanol, ethanol, n-propyl alcohol, isopropyl alcohol, n-amyl alcohol, 2-ethylhexyl alcohol, and lauryl alcohol. The monoalcohol may be a branched aliphatic alcohol so as to improve pigment dispersibility.

The addition of a tri- or higher-valent carboxylic acid or alcohol to the reaction system in the polymerization reaction to synthesize a cross-linked polyester polycondensation polymer can improve the affinity for a dispersion medium.

Examples of the tri- or higher-valent carboxylic acid include, but are not limited to, 1,2,4-benzenetricarboxylic acid (trimellitic acid), 1,3,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxylic-2-methyl-2-methylenecarboxypropane, 1,2,4-cyclohexanetricarboxylic acid, 1,2,7,8-octanetetracarboxylic acid, pyromellitic acid, and acid anhydrides and lower alkyl esters thereof.

Examples of the tri- or higher-valent alcohol include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane, and 1,3,5-trihydroxymethylbenzene.

A toner binder resin according to an embodiment of the present invention will be described below.

Examples of the toner binder resin include, but are not limited to, common styrene-methacrylic acid copolymers, styrene-acrylic acid copolymers, polyester resins, epoxy resins, and styrene-butadiene copolymers. In a method for directly producing toner particles by a polymerization method, a polymerizable monomer for forming the toner particles is used. Specific examples of the polymerizable monomer include, but are not limited to, styrene monomers, such as styrene, α-methylstyrene, α-ethylstyrene, o-methylstyrene, m-methylstyrene, p-methylstyrene, o-ethylstyrene, m-ethylstyrene, and p-ethylstyrene; methacrylate monomers, such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, and methacrylamide; acrylate monomers, such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and acrylamide; and olefin monomers, such as butadiene, isoprene, and cyclohexene. These polymerizable monomers may be used alone or may be used in combination such that the theoretical glass transition temperature (Tg) is in the range of 40° C. to 75° C. (see J. Brandrup, E. H. Immergut, "Polymer Handbook", (the U.S.A.), third edition, John Wiley & Sons, 1989, pp. 209-277). When the theoretical glass transition temperature is within the range described above, this results in satisfactory storage stability and durability and, in the formation of full-color images, satisfactory transparency. The distribution of an additive agent, such as a colorant, a charge control agent, or a wax, in a toner can be controlled by combined use of a nonpolar resin, such as polystyrene, and a polar resin, such as a polyester resin or a polycarbonate resin, as the binder resin. For example, when toner particles are directly manufactured by a suspension polymerization method, a polar resin is added during a polymerization reaction including a dispersion process to a polymerization process. A polar resin is added in accordance with the polarity balance between a polymerizable monomer composition for forming toner particles and an aqueous medium. The concentration of the polar resin can change continuously from the surface to the center of a toner particle, and the polar resin may form a thin layer on the toner particle surface. When the polar resin can interact with the polyester having a bisazo dye skeleton, a colorant, and a charge control agent, it is possible to achieve a desired distribution of the colorant in the toner particle.

A toner according to an embodiment of the present invention contains an azo pigment as a colorant. Examples of the azo pigment include, but are not limited to, monoazo pigments, bisazo pigments, and polyazo pigments. Among others, the polyester having a bisazo dye skeleton has a high affinity for acetoacetanilide pigments, such as C.I. Pigment Yellow 74, C.I. Pigment Yellow 93, C.I. Pigment Yellow 128, C.I. Pigment Yellow 155, C.I. Pigment Yellow 175, and C.I. Pigment Yellow 180. In particular, C.I. Pigment Yellow 155 having the following formula (8) can be well dispersed with the polyester having a bisazo dye skeleton. These pigments may be used alone or in combination.

[Chem. 9]

Formula (8)

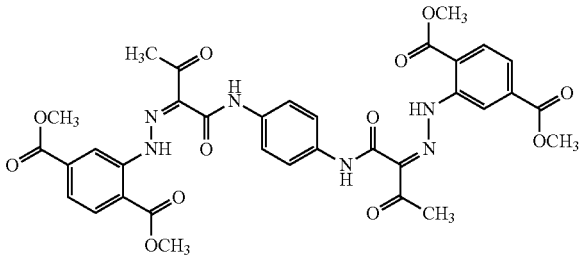

In addition to the pigments described above, any pigment for which the polyester having a bisazo dye skeleton has a high affinity may be suitably used in the present invention.

Examples of such pigments include, but are not limited to, azo pigments, such as C.I. Pigment Orange 1, C.I. Pigment Orange 5, C.I. Pigment Orange 13, C.I. Pigment Orange 15, C.I. Pigment Orange 16, C.I. Pigment Orange 34, C.I. Pigment Orange 36, C.I. Pigment Orange 38, C.I. Pigment Orange 62, C.I. Pigment Orange 64, C.I. Pigment Orange 67, C.I. Pigment Orange 72, C.I. Pigment Orange 74, C.I. Pigment Red 2, C.I. Pigment Red 3, C.I. Pigment Red 4, C.I. Pigment Red 5, C.I. Pigment Red 12, C.I. Pigment Red 16, C.I. Pigment Red 17, C.I. Pigment Red 23, C.I. Pigment Red 31, C.I. Pigment Red 32, C.I. Pigment Red 41, C.I. Pigment Red 17, C.I. Pigment Red 48, C.I. Pigment Red 48:1, C.I. Pigment Red 48:2, C.I. Pigment Red 53:1, C.I. Pigment Red 57:1, C.I. Pigment Red 112, C.I. Pigment Red 144, C.I. Pigment Red 146, C.I. Pigment Red 166, C.I. Pigment Red 170, C.I. Pigment Red 176, C.I. Pigment Red 185, C.I. Pigment Red 187, C.I. Pigment Red 208, C.I. Pigment Red 210, C.I. Pigment Red 220, C.I. Pigment Red 221, C.I. Pigment Red 238, C.I. Pigment Red 242, C.I. Pigment Red 245, C.I. Pigment Red 253, C.I. Pigment Red 258, C.I. Pigment Red 266, C.I. Pigment Red 269, C.I. Pigment Violet 13, C.I. Pigment Violet 25, C.I. Pigment Violet 32, C.I. Pigment Violet 50, C.I. Pigment Blue 25, C.I. Pigment Blue 26, C.I. Pigment Brown 23, C.I. Pigment Brown 25, and C.I. Pigment Brown 41.

These pigments may be crude pigments or may be pigment compositions, provided that the pigment compositions do not significantly reduce the effects of the polyester having a bisazo dye skeleton.

The mass ratio of a pigment to a polyester having a bisazo dye skeleton in a toner according to an embodiment of the present invention is preferably in the range of 100:1 to 100:100, more preferably 100:10 to 100:50 so as to improve pigment dispersibility.

The toner colorant for use in embodiments of the present invention includes the azo pigment. The azo pigment may be used in combination with another colorant that does not significantly impair the dispersibility of the azo pigment.

Examples of such a colorant that may be used in combination with the azo pigment include, but are not limited to, condensed azo compounds, isoindolinone compounds, anthraquinone compounds, azo metal complexes, methine compounds, and allylamide compounds. More specifically, the colorant may be a yellow pigment, such as C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 83, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 129, C.I. Pigment Yellow 147, C.I. Pigment Yellow 151, C.I. Pigment Yellow 154, C.I. Pigment Yellow 168, C.I. Pigment Yellow 174, C.I. Pigment Yellow 176, C.I. Pigment Yellow 181, C.I. Pigment Yellow 185, C.I. Pigment Yellow 191, C.I. Pigment Yellow 194, C.I. Pigment Yellow 213, C.I. Pigment Yellow 214, C.I. Vat Yellow 1, 3, and 20, mineral fast yellow, navel yellow, Naphthol Yellow S, Hansa Yellow G, Permanent Yellow NCG, C.I. Solvent Yellow 9, C.I. Solvent Yellow 17, C.I. Solvent Yellow 24, C.I. Solvent Yellow 31, C.I. Solvent Yellow 35, C.I. Solvent Yellow 58, C.I. Solvent Yellow 93, C.I. Solvent Yellow 100, C.I. Solvent Yellow 102, C.I. Solvent Yellow 103, C.I. Solvent Yellow 105, C.I. Solvent Yellow 112, C.I. Solvent Yellow 162, or C.I. Solvent Yellow 163.

Furthermore, in order to increase the mechanical strength of toner particles and control the molecular weight of the molecules constituting the toner particles, a cross-linker may be used in the synthesis of the binder resin.

The cross-linker may be a bifunctional cross-linker or a polyfunctional cross-linker. Examples of the bifunctional cross-linker include, but are not limited to, divinylbenzene, bis(4-acryloxypolyethoxyphenyl)propane, ethylene glycol di(meth)acrylate, 1,3-butylene glycol di(meth)acrylate, 1,4-butanediol di(meth)acrylate, 1,5-pentanediol di(meth)acrylate, 1,6-hexanediol di(meth)acrylate, neopentyl glycol di(meth)acrylate, diethylene glycol di(meth)acrylate, triethylene glycol di(meth)acrylate, tetraethylene glycol di(meth) acrylate, di(meth)acrylates of poly(ethylene glycol) #200, #400, and #600, dipropylene glycol di(meth)acrylate, poly (propylene glycol) di(meth)acrylate, and polyester di(meth) acrylates.

Examples of the polyfunctional cross-linker include, but are not limited to, pentaerythritol tri(meth)acrylate, trimethylolethane tri(meth)acrylate, trimethylolpropane tri(meth) acrylate, tetramethylolmethane tetra(meth)acrylate, oligoester(meth)acrylates, 2,2-bis(4-methacryloxyphenyl)propane, diallyl phthalate, triallyl cyanurate, triallyl isocyanurate, and triallyl trimellitate.

In terms of toner fixing and offset resistance, the amount of cross-linker is preferably in the range of 0.05 to 10 parts by mass, more preferably 0.1 to 5 parts by mass, per 100 parts by mass of the polymerizable monomer.

Furthermore, in the present invention, in order to reduce deposits on a fixed member, a wax component may be used in the synthesis of the binder resin.

Specific examples of the wax component include, but are not limited to, petroleum waxes and their derivatives, such as paraffin waxes, microcrystalline waxes, and petrolatum, montan wax and its derivatives, Fischer-Tropsch hydrocarbon waxes and their derivatives, polyolefin waxes and their derivatives, such as polyethylene, and natural waxes and their derivatives, such as carnauba wax and candelilla wax. Examples of the derivatives include, but are not limited to, oxides, block copolymers with a vinyl monomer, and graft-modified components. Additional examples of the wax component include, but are not limited to, alcohols, such as higher aliphatic alcohols, fatty acids, such as stearic acid and palmitic acid, fatty acid amides, fatty acid esters, hydrogenated castor oil and its derivatives, vegetable waxes, and animal waxes. These waxes may be used alone or in combination.

The amount of wax component is preferably in the range of 2.5 to 15.0 parts by mass, more preferably 3.0 to 10.0 parts by mass, per 100 parts by mass of the binder resin.

If necessary, the toner may contain a charge control agent. The charge control agent can optimize the triboelectric charging amount for each development system.

The charge control agent may be any known charge control agent, particularly a charge control agent that has a high charging speed and can stably maintain a certain charging amount. In the manufacture of toner particles by a direct polymerization method, it is desirable that the charge control agent does not significantly inhibit the polymerization and be substantially free from a substance soluble in an aqueous dispersion medium.

Examples of the charge control agent include, but are not limited to, charge control agents for negatively charging toner, such as polymers and copolymers having a sulfo group, a sulfonate group, or sulfonate group; salicylic acid derivatives and their metal complexes; monoazo metallic compounds; acetylacetone metallic compounds; aromatic oxycarboxylic acids; aromatic mono- and poly-carboxylic acids and their metal salts, anhydrides, and esters; phenol derivatives, such as bisphenol; urea derivatives; metal-containing naphthoic acid compounds; boron compounds; quaternary ammonium salts; calixarene; and resin-based charge control agents. Examples of the charge control agent also include, but are not limited to, charge control agents for positively charging toner, such as nigrosine and nigrosines modified with fatty acid metal salts, guanidine compounds, imidazole compounds, onium salts, for example, quaternary ammonium salts, such as tributylbenzylammonium-1-hydroxy-4-naphthosulfonate and tetrabutylammonium tetrafluoroborate, and their analogs, such as phosphonium salts, and lake pigments thereof, triphenylmethane dyes and lake pigments thereof (examples of laking agents include, but are not limited to, phosphotungstic acid, phosphomolybdic acid, phosphotungstenmolybdic acid, tannic acid, lauric acid, gallic acid, ferricyanide, and ferrocyanide), higher fatty acid metal salts, diorganotin oxides, such as dibutyltin oxide, dioctyltin oxide, and dicyclohexyltin oxide, diorganotin borates, such as dibutyltin borate, dioctyltin borate, and dicyclohexyltin borate, and resin-based charge control agents. These charge control agents may be used alone or in combination.

The toner particles may contain an inorganic fine powder as a glidant. Examples of the inorganic fine powder include, but are not limited to, silica, titanium oxide, alumina, multiple oxides thereof, and surface-treated powders thereof.

Examples of a method for manufacturing toner particles include, but are not limited to, a pulverization method, a suspension polymerization method, a suspension granulation method, and an emulsion polymerization method. Among these methods, toner particles may be manufactured in an aqueous medium by a suspension polymerization method or a suspension granulation method in terms of environmental load in manufacture and particle size controllability.

In order to improve pigment dispersibility in the manufacture of a toner, a polyester having a bisazo dye skeleton and an azo pigment may be mixed in advance to prepare a pigment composition.

The pigment composition may be manufactured by a wet process or a dry process. Since a polyester having a bisazo dye skeleton has a high affinity for a water-insoluble solvent, a uniform pigment composition can be easily manufactured by a wet process. More specifically, the pigment composition may be manufactured as described below. A polyester having a bisazo dye skeleton and an optional resin are dissolved in a dispersion medium. A pigment powder is added to and sufficiently blended with the dispersion medium while stirring. The pigment can be stably, uniformly, and finely dispersed by mechanical shear force with a dispersing apparatus, such as a kneader, a rolling mill, a ball mill, a paint shaker, a dissolver, an attritor, a sand mill, or a high-speed mill.

The dispersion medium for use in the pigment composition is not particularly limited and may be a water-insoluble solvent so as to improve the pigment dispersing effect of the polyester having a bisazo dye skeleton. Examples of the water-insoluble solvent include, but are not limited to, esters, such as methyl acetate, ethyl acetate, and propyl acetate; hydrocarbons, such as hexane, octane, petroleum ether, cyclohexane, benzene, toluene, and xylene; and halogen-containing hydrocarbons, such as carbon tetrachloride, trichloroethylene, and tetrabromoethane.

The dispersion medium for use in the pigment composition may be a polymerizable monomer. Specific examples of the polymerizable monomer include, but are not limited to, styrene, α-methylstyrene, α-ethylstyrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, ethylene, propylene, butylene, isobutylene, vinyl chloride, vinylidene chloride, vinyl bromide, vinyl iodide, vinyl acetate, vinyl propionate, vinyl benzoate, methyl methacrylate, ethyl methacrylate, propyl methacrylate, butyl methacrylate, n-octyl methacrylate, dodecyl methacrylate, 2-ethylhexyl methacrylate, stearyl methacrylate, behenyl methacrylate, phenyl methacrylate, dimethylaminoethyl methacrylate, diethylaminoethyl methacrylate, methyl acrylate, ethyl acrylate, n-butyl acrylate, isobutyl acrylate, propyl acrylate, n-octyl acrylate, dodecyl acrylate, 2-ethylhexyl acrylate, stearyl acrylate, behenyl acrylate, 2-chloroethyl acrylate, phenyl acrylate, vinyl methyl ether, vinyl ethyl ether, vinyl isobutyl ether, vinyl methyl ketone, vinyl hexyl ketone, methyl isopropenyl ketone, vinyl naphthalene, acrylonitrile, methacrylonitrile, and acrylamide.

The resin for use in the pigment composition may be a binder resin for use in a toner according to an embodiment of the present invention. Specific examples of the resin include, but are not limited to, styrene-methacrylic acid copolymers, styrene-acrylic acid copolymers, polyester resins, epoxy resins, and styrene-butadiene copolymers. These resins may be used alone or in combination. The pigment composition may be isolated by a known method, for example, filtration, decantation, or centrifugation. The solvent may be removed by washing.

An auxiliary agent may be added to the pigment composition during the manufacturing process. Specific examples of the auxiliary agent include, but are not limited to, surfactants, pigment and non-pigment dispersants, fillers, standardizers, resins, waxes, antifoaming agents, antistatic agents, dustproofing agents, extenders, shading colorants, preservatives, drying control chemical additives, rheology control additive agents, wetting agents, antioxidants, UV absorbers, light stabilizers, and combinations thereof. The polyester having a bisazo dye skeleton may be added in advance in the manufacture of a crude pigment.

A method for manufacturing toner particles by a suspension polymerization method will be described below. A pigment composition, a polymerizable monomer, a wax component, and a polymerization initiator are mixed to prepare a polymerizable monomer composition. The polymerizable monomer composition is then dispersed in an aqueous medium to form particles of the polymerizable monomer composition. The polymerizable monomer in the particles of the polymerizable monomer composition is polymerized in the aqueous medium to form toner particles.

The polymerizable monomer composition may be prepared by mixing a dispersion liquid containing the pigment composition dispersed in a first polymerizable monomer with a second polymerizable monomer. More specifically, the pigment composition is well dispersed in the first polymerizable monomer and, together with other toner materials, is then mixed with the second polymerizable monomer. This allows the pigment to be well dispersed in the toner particles.

Examples of the polymerization initiator for use in the suspension polymerization method include, but are not limited to, known polymerization initiators, such as azo compounds, organic peroxides, inorganic peroxides, organometallic compounds, and photopolymerization initiators. Specific examples of the polymerization initiator include, but are not limited to, azo polymerization initiators, such as 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile), and dimethyl 2,2'-azobis (isobutyrate); organic peroxide polymerization initiators, such as benzoyl peroxide, di-tert-butyl peroxide, tert-butylperoxyisopropyl monocarbonate, tert-hexyl perbenzoate, and tert-butyl perbenzoate; inorganic peroxide polymerization initiators, such as potassium persulfate and ammonium persulfate; redox initiators, such as hydrogen peroxide-iron(II), BPO-dimethylaniline, and cerium(IV) salts-alcohols. Examples of the photopolymerization initiators include, but are not limited to, acetophenone, benzoin ethers, and ketals. These polymerization initiators may be used alone or in combination.

The concentration of the polymerization initiator is preferably 0.1 to 20 parts by mass, more preferably 0.1 to 10 parts by mass, per 100 parts by mass of the polymerizable monomer. The type of polymerizable initiator may be slightly different for each polymerization method. The polymerizable initiators may be used alone or in combination in consideration of their 10-hour half-life temperatures.

The aqueous medium for use in the suspension polymerization method may contain a dispersion stabilizer. The dispersion stabilizer may be a known inorganic or organic dispersion stabilizer. Examples of the inorganic dispersion stabilizer include, but are not limited to, calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersion stabilizer include, but are not limited to, poly(vinyl alcohol), gelatin, methylcellulose, methylhydroxypropylcellulose, ethylcellulose, a sodium salt of carboxymethylcellulose, and starch. Nonionic, anionic, and cationic surfactants may also be used. Examples of these surfactants include, but are not limited to, sodium dodecyl sulfate, sodium tetradecyl sulfate, sodium pentadecyl sulfate, sodium octyl sulfate, sodium oleate, sodium laurate, potassium stearate, and calcium oleate.

The dispersion stabilizer may be a poorly water-soluble inorganic dispersion stabilizer that is soluble in an acid. In the preparation of an aqueous dispersion medium using a poorly water-soluble inorganic dispersion stabilizer, the amount of dispersion stabilizer may be in the range of 0.2 to 2.0 parts by mass per 100 parts by mass of the polymerizable monomer. This can improve the stability of droplets of the polymerizable monomer composition in the aqueous medium. The aqueous medium may be prepared using 300 to 3000 parts by mass of water per 100 parts by mass of the polymerizable monomer composition.

In the preparation of an aqueous medium containing a poorly water-soluble inorganic dispersion stabilizer dispersed therein, a commercially available dispersion stabilizer may be directly used. In order to form fine and uniform dispersion stabilizer particles, a poorly water-soluble inorganic dispersion stabilizer may be produced in water while stirring at high speed. For example, using calcium phosphate as a dispersion stabilizer, aqueous sodium phosphate and aqueous calcium chloride are mixed while stirring at high speed to form calcium phosphate fine particles as a dispersion stabilizer.

A method for manufacturing toner particles by a suspension granulation method will be described below. A manufacturing process utilizing the suspension granulation method includes no heating step. When a low-melting-point wax is used, therefore, this reduces compatibility between a resin and the wax component and prevents the glass transition temperature of toner from being decreased because of high compatibility. Various binder resins, including polyester resins, may be used for the suspension granulation method. Polyester resins can be used as main components of the toner materials and improve toner fixing. Thus, the suspension granulation method is favorable for the manufacture of a toner of a resin composition to which the suspension polymerization method cannot be applied.

Toner particles may be manufactured by the suspension granulation method as described below. First, a pigment composition, a binder resin, and a wax component are mixed in a solvent to prepare a resin solution. The resin solution is then dispersed in an aqueous medium to prepare a toner particle suspension containing particles of the resin solution. The suspension was heated or placed under reduced pressure to remove the solvent, thereby forming toner particles.

The resin solution may be prepared by mixing a dispersion liquid containing the pigment composition dispersed in a first solvent with a second solvent. More specifically, the pigment composition is well dispersed in the first solvent and, together with other toner materials, is then mixed with the second solvent. This allows the pigment to be well dispersed in the toner particles.

Examples of the solvent for use in the suspension granulation method include, but are not limited to, hydrocarbons, such as toluene, xylene, and hexane; halogen-containing hydrocarbons, such as methylene chloride, chloroform, dichloroethane, trichloroethane, and carbon tetrachloride; alcohols, such as methanol, ethanol, butanol, and isopropyl alcohol; polyhydric alcohols, such as ethylene glycol, propylene glycol, diethylene glycol, and triethylene glycol; cellosolves, such as methyl cellosolve and ethyl cellosolve; ketones, such as acetone, methyl ethyl ketone, and methyl isobutyl ketone; ethers, such as benzyl alcohol ethyl ether, benzyl alcohol isopropyl ether, and tetrahydrofuran; and esters, such as methyl acetate, ethyl acetate, and butyl acetate. These solvents may be used alone or in combination. The solvent may have a low boiling point so as to facilitate solvent removal from the toner particle suspension and sufficiently dissolve the binder resin.

The amount of solvent to be used is preferably in the range of 50 to 5000 parts by mass, more preferably 120 to 1000 parts by mass, per 100 parts by mass of the binder resin.

The aqueous medium for use in the suspension granulation method may contain a dispersion stabilizer. The dispersion stabilizer may be the dispersion stabilizer described for the suspension polymerization method.

The amount of dispersant to be used may be in the range of 0.01 to 20 parts by mass per 100 parts by mass of the binder resin so as to improve the stability of droplets of the resin solution in the aqueous medium.

The weight average particle size (hereinafter referred to as D4) of toner is preferably in the range of 3.00 to 15.0 μm, more preferably 4.00 to 12.0 μm.

The ratio of D4 to number average particle size (hereinafter referred to as D1) of toner (hereinafter referred to as D4/D1) may be 1.35 or less, preferably 1.30 or less.

D4 and D1 of toner may be controlled differently for different methods for manufacturing toner particles. For example, in the case of the suspension polymerization method, D4 and D1 may be controlled via the dispersant concentration in the preparation of the aqueous dispersion medium or the agitation speed or the agitation time in the reaction.

A toner according to an embodiment of the present invention may be a magnetic toner or a nonmagnetic toner. Toner particles of a magnetic toner may contain a magnetic material. Examples of the magnetic material include, but are not limited to, iron oxides, such as magnetite, maghemite, and ferrite, iron oxides containing other metal oxides, metals, such as Fe, Co, and Ni, alloys of these metals and another metal, such as Al, Co, Cu, Pb, Mg, Ni, Sn, Zn, Sb, Be, Bi, Cd, Ca, Mn, Se, Ti, W, or V, and mixtures thereof.

Examples

Unless otherwise specified, "part" and "%" in the following description are based on mass.

The following are measurement methods used in the present examples.

(1) Measurement of Molecular Weight

The molecular weights of a polyester resin (polyester moiety) and a polyester having a bisazo dye skeleton were polystyrene equivalents determined by size exclusion chromatography (SEC). The molecular weight based on SEC was measured as described below.

A sample diluted to a concentration of 1.0% with an eluent was left still at room temperature for 24 hours and was passed through a solvent resistant membrane filter having a pore size of 0.2 μm. The molecular weight of the resulting sample solution was measured under the following conditions.

Apparatus: high performance GPC "HLC-8220 GPC" [manufactured by Tosoh Corp.]

Column: two LF-804 in series

Eluent: THF

Flow rate: 1.0 ml/min

Oven temperature: 40° C.

Sample injection: 0.025 ml

The molecular weight of the sample was calculated from a molecular weight calibration curve, which was prepared using standard polystyrene resins [TSK standard polystyrene F-850, F-450, F-288, F-128, F-80, F-40, F-20, F-10, F-4, F-2, F-1, A-5000, A-2500, A-1000, and A-500 manufactured by Tosoh Corp.].

(2) Measurement of Acid Value

The acid values of a polyester resin (polyester moiety) and a polyester having a bisazo dye skeleton were measured by the following method.

The basic procedures complied with JIS K-0070.

1) 0.5 to 2.0 g of a sample was precisely weighed. The mass was denoted as W (g).

2) The sample was dissolved in 25 ml of a tetrahydrofuran/ethanol (2/1) mixture in a 50-ml beaker.

3) The sample was titrated with 0.1 mol/1 KOH in ethanol using a potentiometric titrator [for example, an automatic titrator "COM-2500" manufactured by Hiranuma Sangyo Co., Ltd.].

4) The amount of KOH solution used was denoted as S (ml). The amount of KOH solution used for blank measurement was denoted as B (ml).

5) The acid value was calculated using the following equation. f denotes the factor of the KOH solution.

$$\text{Acid value [mg KOH/g]} = \frac{(S-B)\times f\times 5.61}{W} \quad \text{[Math. 1]}$$

(3) Composition Analysis

The structures of a polyester resin and a polyester having a bisazo dye skeleton were determined with the following apparatus.

$^1$H NMR

ECA-400 manufactured by JEOL Ltd. (solvent: deuteriochloroform)

Synthesis Example 1 of Polyester Resin 31.6 parts of a 1.0 mol ethylene oxide adduct of bisphenol A, 14.8 parts of terephthalic acid, 5.5 parts of a cross-linker glycerin, and 0.0005 parts of a catalyst di-n-butyltin oxide in a four-neck flask were melted and stirred at 200° C. in an inert nitrogen gas atmosphere. When the production of a by-product water was completed, the resulting mixture was heated to 230° C. for approximately one hour and was stirred for two hours. A resin in a molten state was removed. The resin was cooled at normal temperature and was washed with water to yield a resin (A). The physical properties of the resin (A) were measured with the apparatuses described above. The analysis results were as follows:

Analysis Results for Resin (A)

[1] Molecular Weight Measurement (GPC):

Weight-average molecular weight (Mw)=10508

Number-average molecular weight (Mn)=3543

[2] Acid Value Measurement:

11.6 mgKOH/g

[3] $^1$H NMR (400 MHz, $CDCl_3$, at room temperature): δ [ppm]=8.06 (3.7H, s), 7.15 (4H, d), 6.89 (4H, d), 5.48-5.32 (0.6H, m), 4.72-3.63 (2.4, m), 1.68 (6H, s), 1.47 (4H, d), 1.42-1.22 (4H, m)

Synthesis Example 2 of Polyester Resin 200 parts of 12-hydroxystearic acid, 8.24 parts of stearic acid for blocking a terminal hydroxy group, and 56.8 parts of xylene in a four-neck flask were melted at 140° C. 0.485 parts of a catalyst titanium tetraisopropoxide was added to the resulting liquid mixture, and the liquid mixture was heated to 180° C. The liquid mixture was stirred at 180° C. for 42 hours while a by-product water was removed. After the completion of the reaction, xylene was distilled off, and the product was dried under reduced pressure to yield a resin (B). The physical properties of the resin (B) were measured with the apparatuses described above. The analysis results were as follows:

Analysis Results for Resin (B)

[1] Molecular Weight Measurement (GPC):

Weight-average molecular weight (Mw)=5069

Number-average molecular weight (Mn)=2636

[2] Acid Value Measurement:

31.9 mgKOH/g

[3] $^1$H NMR (400 MHz, $CDCl_3$, at room temperature): δ [ppm]=4.99 (1H, m), 2.19 (2H, t), 2.10 (0.5H, t), 1.61-1.42 (7H, m), 1.28-1.15 (28H, m), 0.88 (4H, t) Synthesis Example 3 of Polyester Resin 50.0 parts of ε-caprolactone and 0.57 parts of 2-ethylhexanol were mixed in a four-neck flask and were melted at 120° C. 0.04 parts of a catalyst titanium tetraisopropoxide was added to the resulting liquid mixture, and the liquid mixture was stirred for five hours. After the completion of the reaction, the resulting product was diluted with THF and was reprecipitated in methanol. The resulting precipitate was filtered off to yield a resin (C). The physical properties of the resin (C) were measured with the apparatuses described above. The analysis results were as follows:

Analysis Results for Resin (C)

[1] Molecular Weight Measurement (GPC):

Weight-average molecular weight (Mw)=7198

Number-average molecular weight (Mn)=9722

[2] Acid Value Measurement:

1.13 mgKOH/g

[3] $^1$H NMR (400 MHz, $CDCl_3$, at room temperature): δ [ppm]=4.06 (78H, t), 3.65 (2H, t), 2.63 (0.5H, t), 2.31 (78H, t), 1.67-1.22 (243H, m), 0.89 (2.5H, m)

In the same way as the resins (A) to (C), resins (D) to (J) listed in Table 1 were prepared. The results are described below.

TABLE 1

Polyester Resins (A) to (J)

| Resin symbol | Components: Monomer unit A | Components: Monomer unit B |
|---|---|---|
| Resin (A) | 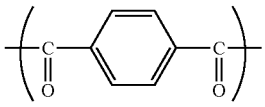 | 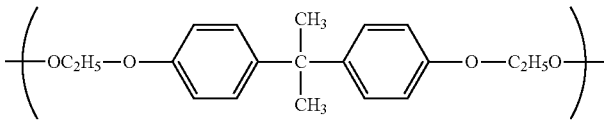 |
| Resin (B) | 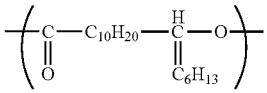 | None |
| Resin (C) | 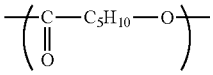 | None |
| Resin (D) | 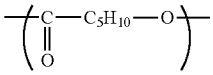 | None |
| Resin (E) | 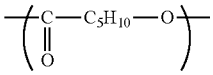 | None |
| Resin (F) | 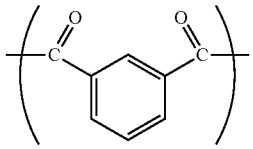 | 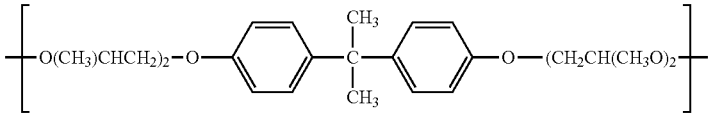 |
| Resin (G) | 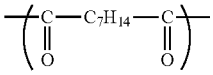 | 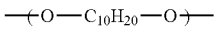 |
| Resin (H) | 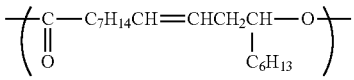 | None |
| Resin (I) | 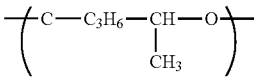 | None |
| Resin (J) | 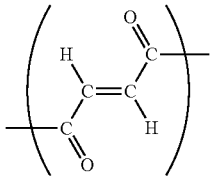 | 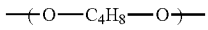 |

| Resin symbol | Cross-linker | COOH group blocker | OH group blocker | Mw |
|---|---|---|---|---|
| Resin (A) | None | None | None | 10508 |
| Resin (B) | None | None | Stearic acid | 5069 |
| Resin (C) | None | 2-ethylhexanol | None | 7198 |
| Resin (D) | None | 2-(4-nitrophenyl)ethanol | None | 9722 |

TABLE 1-continued

| Polyester Resins (A) to (J) | | | | |
|---|---|---|---|---|
| Resin (E) | None | None | Isostearic acid | 10231 |
| Resin (F) | Trimellitic acid | None | None | 9854 |
| Resin (G) | None | None | None | 18240 |
| Resin (H) | None | None | Oleic acid | 6996 |
| Resin (I) | None | None | None | 11256 |
| Resin (J) | None | None | None | 16550 |

A polyester having the bisazo dye skeleton represented by the formula (1) or (2) was prepared by the following method.

Synthesis Example 1 of Azo Dye Intermediate (74)

An azo dye intermediate (74) having the following structure was prepared in accordance with the following scheme.

[Chem. 10]

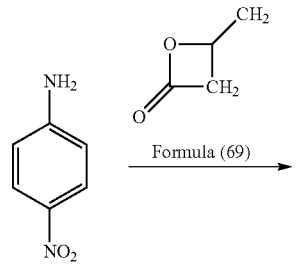

Formula (68)

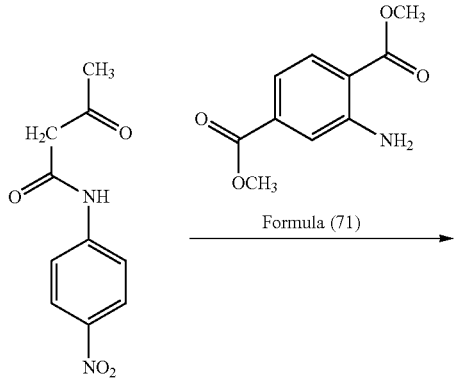

Formula (70)

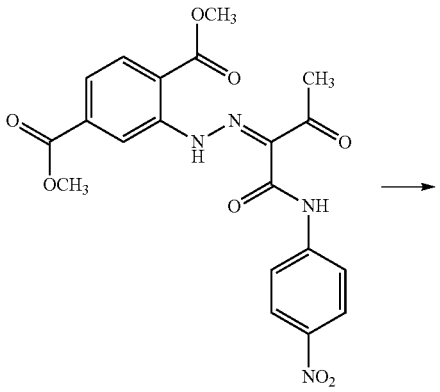

Formula (72)

-continued

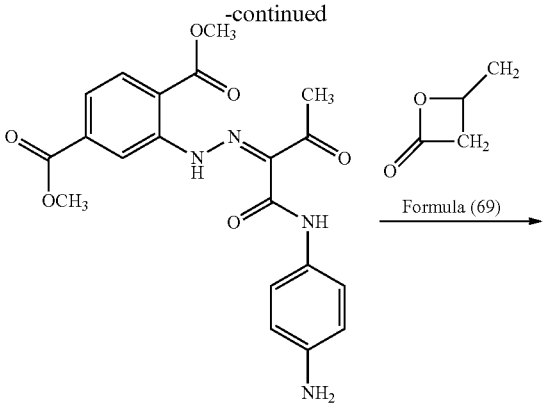

Formula (73)

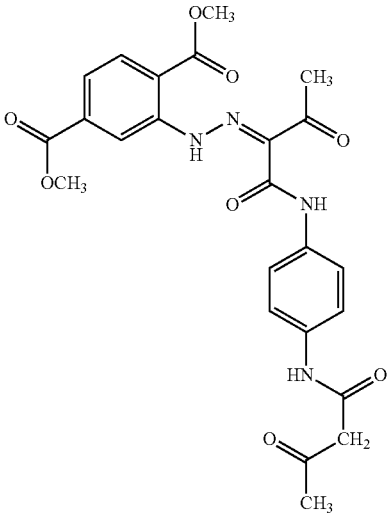

Formula (74)

3.11 parts of p-nitroaniline (68) was added to 30 parts of chloroform. The resulting mixture was cooled in ice to 10° C. or less. 1.89 parts of diketene (69) was added to the mixture. The mixture was stirred at 65° C. for two hours. After the completion of the reaction, a chloroform extract was concentrated to yield 4.80 parts of a compound (70) (yield: 96.0%).

40.0 parts of methanol and 5.29 parts of concentrated hydrochloric acid were added to 4.25 parts of dimethyl 2-aminoterephthalate (71). The resulting mixture was cooled in ice to 10° C. or less. 2.10 parts of sodium nitrite dissolved in 6.00 parts of water was added to the mixture. The mixture was allowed to react at that temperature for one hour. 0.990 parts of sulfamic acid was added to the mixture. The mixture was stirred for 20 minutes to yield a diazonium salt solution. 4.51 parts of the compound (70) was added to 70.0 parts of methanol. The resulting mixture was cooled in ice to 10° C. or less. The diazonium salt solution was added to the mixture. 5.83 parts of sodium acetate dissolved in 7.00 parts of water was added to the mixture. The mixture was allowed to react at 10° C. or less for two hours. After the completion of the reaction, 300 parts of water was added to the mixture. The mixture was stirred for 30 minutes and was passed through a filter to remove solids. Purification by recrystallization from N,N-dimethylformamide yielded 8.65 parts of a compound (72) (yield: 96.1%).

8.58 parts of the compound (72) and 0.40 parts of palladium-activated carbon (palladium: 5%) were added to 150 parts of N,N-dimethylformamide. The resulting mixture was stirred at 40° C. for three hours in a hydrogen gas atmosphere (reaction pressure: 0.1 to 0.4 MPa). After the completion of the reaction, the mixture was passed through a filter and was concentrated to yield 7.00 parts of a compound (73) (yield: 87.5%).

6.50 parts of the compound (73) was added to 30.0 parts of chloroform. The resulting mixture was cooled in ice to 10° C. or less. 0.95 parts of diketene (69) was added to the mixture. The mixture was stirred at 65° C. for two hours. After the completion of the reaction, a chloroform extract was concentrated to yield 6.92 parts of an azo dye intermediate (74) (yield: 93.0%). Synthesis Example 1 of Polyester Having Bisazo Dye Skeleton A polyester (35) having a bisazo dye skeleton was prepared from the azo dye intermediate (74) in accordance with the following scheme.

[Chem. 11]

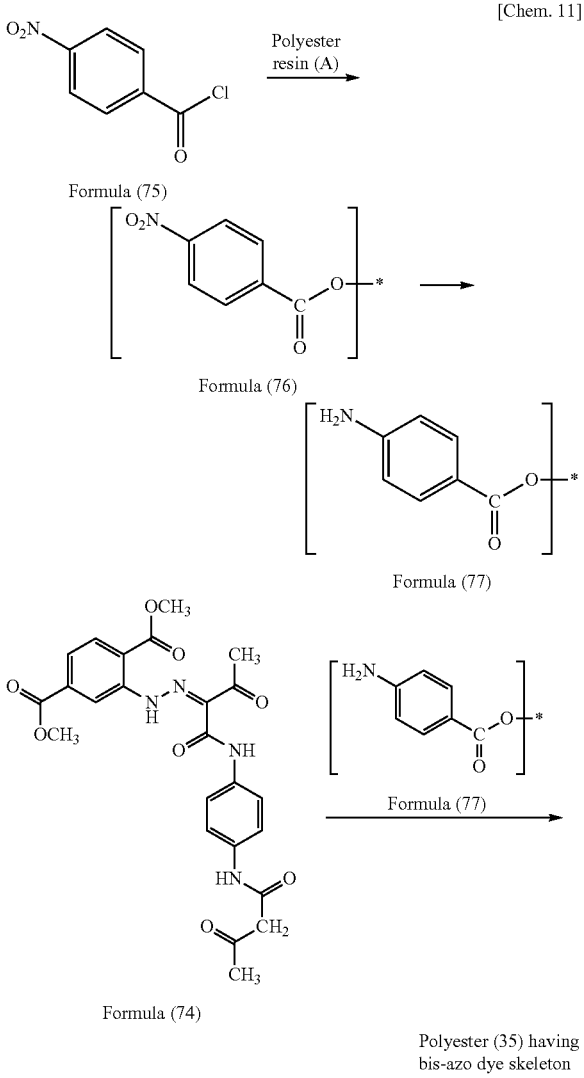

"*" denotes a linkage with the polyester resin.

10.0 parts of the polyester resin (A) synthesized in Synthesis Example 1 was dissolved in 50.0 parts of pyridine and was cooled in ice to 10° C. or less. 2.00 parts of a compound (75) was added to the resulting solution. The solution was stirred at room temperature for 12 hours. After the completion of the reaction, an organic phase of the solution was extracted with chloroform and was washed with water. The solution which had been extracted with chloroform was concentrated and was purified by reprecipitation in methanol to yield 9.5 parts of a compound (76) (yield: 95.0%).

9.50 parts of the compound (76) and 0.66 parts of palladium-activated carbon (palladium: 5%) were added to 20.0 parts of dehydrated tetrahydrofuran and were stirred at room temperature for 48 hours in a hydrogen gas atmosphere (reaction pressure: 0.01 to 0.1 MPa). After the completion of the reaction, the solution was passed through a filter and was concentrated to yield 8.7 parts of a compound (77) (yield: 91.6%).

40.0 parts of tetrahydrofuran and 0.50 parts of concentrated hydrochloric acid were added to 8.0 parts of the compound (77). The resulting mixture was cooled in ice to 10° C. or less. 0.18 parts of sodium nitrite dissolved in 0.60 parts of water was added to the mixture. The mixture was allowed to react at that temperature for one hour to yield a diazonium salt solution. 0.70 parts of the compound (74) was dissolved in 50.0 parts of N,N-dimethylformamide at 80° C. After the resulting solution was cooled to 50° C., 0.89 parts of potassium carbonate dissolved in 1.8 parts of water was added to the solution. The solution was cooled in ice to 10° C. or less. The diazonium salt solution was added to the solution and was allowed to react at 10° C. or less for two hours. After the completion of the reaction, the solution was concentrated. An organic phase of the solution was extracted with chloroform and was washed with water. The solution was concentrated and was purified by reprecipitation in methanol to yield 7.50 parts of the polyester (35) having a bisazo dye skeleton (yield: 93.80).

The product was analyzed using the apparatuses described above and was found to have the structure described above. The analysis results were as follows: Analysis Results for Polyester (35) Having Bisazo Dye Skeleton

[1] Molecular Weight Measurement (GPC):

Weight-average molecular weight (Mw)=18065

Number-average molecular weight (Mn)=9523

[2] Acid Value Measurement:

0.3439 mgKOH/g

[3] $^1$H NMR (400 MHz, $CDCl_3$, at room temperature) (see FIG. 1): δ [ppm]=15.64 (s, 1H), 14.77 (s, 1H), 11.43 (s, 1H), 8.61 (s, 1H), 8.04 (m, 68H), 7.13 (m, 74H), 6.81 (m, 73H), 5.49-5.29 (m, 32H), 4.71 (m, 3H), 4.44 (m, 8H), 3.91 (m, 94H), 2.68 (s, 3H), 2.17 (s, 1H), 1.85-1.22 (m, 283H) Synthesis Example 2 of Polyester Having Bisazo Dye Skeleton (38)

A polyester (38) having a bisazo dye skeleton was prepared from the azo dye intermediate (74) in accordance with the following scheme.

[Chem. 12]

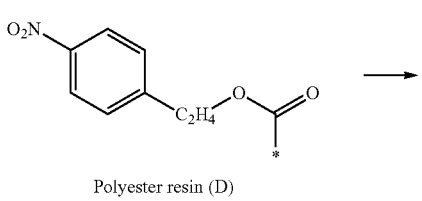

-continued

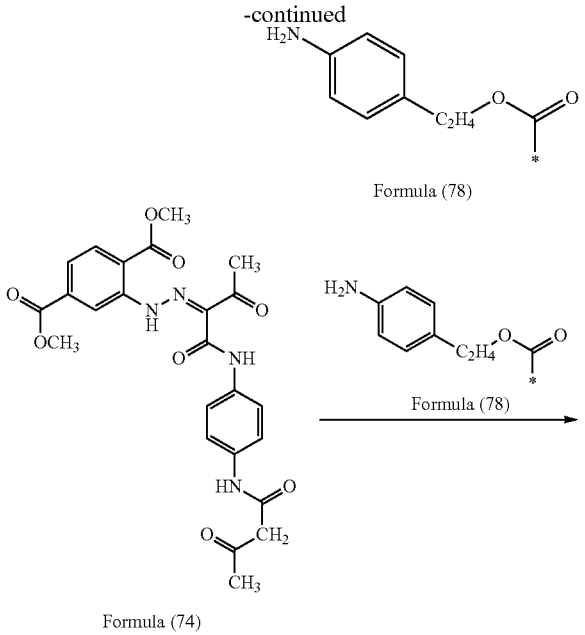

"*" denotes a linkage with the polyester resin.

20.0 parts of the polyester resin (D) synthesized in Synthesis Example 1 was dissolved in 50.0 parts of dehydrated tetrahydrofuran. 0.53 parts of palladium-activated carbon (palladium: 5%) was added to the resulting solution. The solution was stirred at room temperature for 24 hours in a hydrogen gas atmosphere (reaction pressure: 0.05 to 0.1 MPa). After the completion of the reaction, the solution was passed through a filter and was concentrated to yield 18.3 parts of a compound (78) (yield: 91.5%).

50.0 parts of tetrahydrofuran and 0.69 parts of concentrated hydrochloric acid were added to 15.0 parts of the compound (78). The resulting mixture was cooled in ice to 10° C. or less. 0.29 parts of sodium nitrite dissolved in 0.87 parts of water was added to the mixture. The mixture was allowed to react at that temperature for one hour to yield a diazonium salt solution. 1.17 parts of the compound (74) was dissolved in 75.0 parts of N,N-dimethylformamide at 80° C. After the resulting solution was cooled to 50° C., 1.41 parts of potassium carbonate dissolved in 2.80 parts of water was added to the solution. The solution was cooled in ice to 10° C. or less. The diazonium salt solution was added to the solution and was allowed to react at 10° C. or less for two hours. After the completion of the reaction, the solution was concentrated. An organic phase of the solution was extracted with chloroform and was washed with water. The solution was concentrated and was purified by reprecipitation in methanol to yield 11.0 parts of the polyester (38) having a bisazo dye skeleton (yield: 73.3%).

The product was analyzed using the apparatuses described above and was found to have the structure described above. The analysis results were as follows: Analysis Results for Polyester (38) Having BisAzo Dye Skeleton

[1] Molecular Weight Measurement (GPC):

Weight-average molecular weight (Mw)=12242

Number-average molecular weight (Mn)=10636

[2] Acid Value Measurement:

1.449 mgKOH/g

Figure 2:
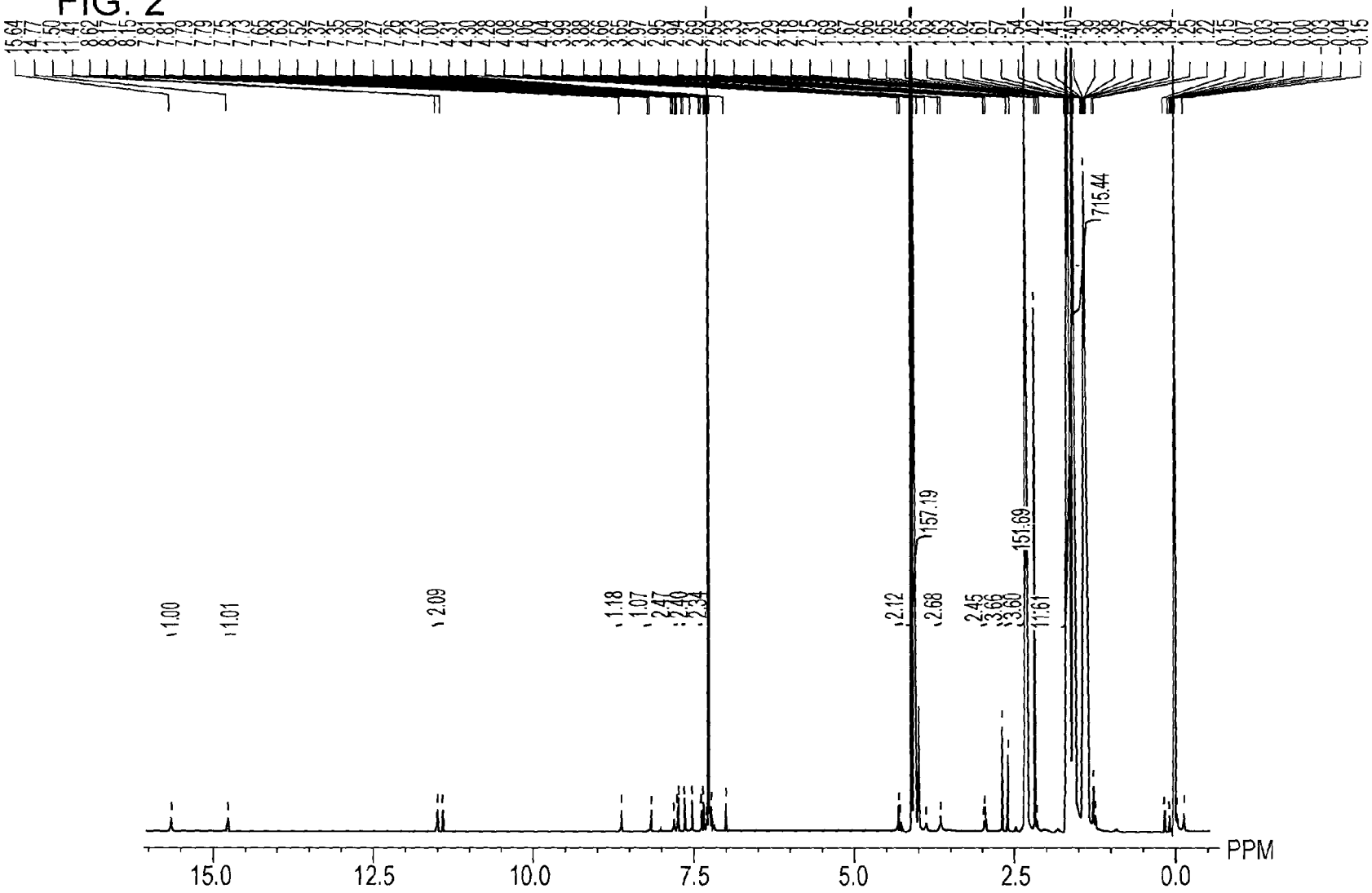
FIG. 2 is a $^1$H NMR spectrum of a polyester (38) having a bisazo dye skeleton measured at 400 MHz in $CDCl_3$ at room temperature.

[3] $^1$H NMR (400 MHz, $CDCl_3$, at room temperature) (see FIG. 2): δ [ppm]=15.64 (s, 1H), 14.77 (s, 1H), 11.50 (s, 1H), 11.41 (s, 1H), 8.62 (s, 1H), 8.16 (d, 1H), 7.79 (d, 1H), 7.74 (d, 2H), 7.64 (d, 2H), 7.52 (s, 2H), 7.36 (d, 2H), 4.30 (t, 2H), 4.06 (t, 157H), 3.65 (t, 2H), 2.95 (t, 2H), 2.69 (s, 3H), 2.59 (s, 3H), 2.31 (t, 152H), 1.69-1.22 (m, 715H)

Polyesters (36), (37), and (39) to (67) having the bisazo dye skeleton represented by the formula (1) or (2) were prepared in the same way as the polyesters (35) and (38) having a bisazo dye skeleton. Tables 2-1 and 2-2 listed the polyesters having a bisazo dye skeleton.

TABLE 2-1

Polyester Having Bis-Azo Dye Skeleton

| Compound No. | General formula | $R_1$ | $R_2$ | $R_3$ | $R_4$ | $R_5$ | $R_6$ | $R_7$ | $R_8$ | $R_9$ | $R_{10}$ | $R_{11}$ |
|---|---|---|---|---|---|---|---|---|---|---|---|---|
| (35) | (79) | H | H | H | H | $CH_3$ | $CH_3$ | $COOCH_3$ | H | H | $COOCH_3$ | H |
| (36) | (79) | H | H | H | H | $CH_3$ | $CH_3$ | $COOCH_3$ | H | H | $COOCH_3$ | H |
| (37) | (79) | H | H | H | H | $CH_3$ | $CH_3$ | $COOCH_3$ | H | H | $COOCH_3$ | H |
| (38) | (79) | H | H | H | H | $CH_3$ | $CH_3$ | $COOCH_3$ | H | H | $COOCH_3$ | H |
| (39) | (79) | H | H | H | H | $CH_3$ | $CH_3$ | $COOCH_3$ | H | H | $COOCH_3$ | H |
| (40) | (79) | H | H | H | H | $CH_3$ | $CH_3$ | $COOCH_3$ | H | H | $COOCH_3$ | H |
| (41) | (79) | H | H | H | H | $CH_3$ | $CH_3$ | $COOCH_3$ | H | H | $COOCH_3$ | H |
| (42) | (79) | H | H | H | H | $CH_3$ | $CH_3$ | $COOCH_3$ | H | H | $COOCH_3$ | H |
| (43) | (79) | H | H | H | H | $CH_3$ | $CH_3$ | $COOCH_3$ | H | H | $COOCH_3$ | H |
| (44) | (79) | H | H | H | H | $CH_3$ | $CH_3$ | $COOCH_3$ | H | H | $COOCH_3$ | H |
| (45) | (79) | H | H | H | H | $C_6H_{12}$(n) | Ph | $COOCH_3$ | H | H | $COOCH_3$ | H |
| (46) | (79) | Cl | H | H | H | $CH_3$ | $CH_3$ | $COOCH_3$ | H | H | $COOCH_3$ | H |
| (47) | (79) | Cl | H | Cl | H | $CH_3$ | $CH_3$ | $COOCH_3$ | H | H | $COOCH_3$ | H |
| (48) | (79) | H | H | H | H | $CH_3$ | $CH_3$ | $COOCH_3$ | H | H | $COOCH_3$ | H |
| (49) | (79) | H | H | H | H | $CH_3$ | $CH_3$ | $COOCH_3$ | H | H | $COOCH_3$ | H |
| (50) | (79) | H | H | H | H | $CH_3$ | $CH_3$ | $COOCH_3$ | H | H | $COOCH_3$ | H |
| (51) | (79) | H | H | H | H | $CH_3$ | $CH_3$ | $COOCH_3$ | H | H | $COOCH_3$ | H |

| Compound | Substitution position of $L_1$ in formulae (79) to (82) and structure of $L_1$ | | | | | |
|---|---|---|---|---|---|---|
| No. | 2-position | 3-position | 4-position | 5-position | 6-position | Resin |
| (35) | H | H | $-\overset{\overset{O}{\|}}{C}-O-*$ | H | H | (A) |

TABLE 2-1-continued

| Polyester Having Bis-Azo Dye Skeleton | | | | | | |
|---|---|---|---|---|---|---|
| (36) | H | H | $-\overset{\overset{O}{\|}}{C}-O-*$ | H | H | (B) |
| (37) | H | H | $-\overset{\overset{O}{\|}}{C}-O-*$ | H | H | (C) |
| (38) | H | H | $-C_2H_4O-\overset{\overset{O}{\|}}{C}-*$ | H | H | (D) |
| (39) | H | H | $-\overset{\overset{O}{\|}}{C}-O-*$ | H | H | (E) |
| (40) | H | H | $-\overset{\overset{O}{\|}}{C}-O-*$ | H | H | (F) |
| (41) | H | H | $-\overset{\overset{O}{\|}}{C}-O-*$ | H | H | (G) |
| (42) | H | H | $-\overset{\overset{O}{\|}}{C}-O-*$ | H | H | (H) |
| (43) | H | H | $-\overset{\overset{O}{\|}}{C}-O-*$ | H | H | (I) |
| (44) | H | H | $-\overset{\overset{O}{\|}}{C}-O-*$ | H | H | (J) |
| (45) | H | H | $-C_2H_5O-\overset{\overset{O}{\|}}{C}-*$ | H | H | (D) |
| (46) | H | H | $-C_2H_5O-\overset{\overset{O}{\|}}{C}-*$ | H | H | (D) |
| (47) | H | H | $-C_2H_5O-\overset{\overset{O}{\|}}{C}-*$ | H | H | (D) |
| (48) | H | $-\overset{\overset{O}{\|}}{C}-O-*$ | H | H | H | (C) |
| (49) | $-\overset{\overset{O}{\|}}{C}-O-*$ | H | H | H | H | (C) |
| (50) | H | $-\overset{\overset{O}{\|}}{C}-O-*$ | H | $-\overset{\overset{O}{\|}}{C}-O-*$ | H | (C) |
| (51) | H | H | $-\underset{\underset{O}{\|}}{\overset{\overset{O}{\|}}{S}}-O-*$ | H | H | (C) |

TABLE 2-2

| Polyester Having Bis-Azo Dye Skeleton | | | | | | | | | | | | |
|---|---|---|---|---|---|---|---|---|---|---|---|---|
| Compound No. | General formula | $R_1$ | $R_2$ | $R_3$ | $R_4$ | $R_5$ | $R_6$ | $R_7$ | $R_8$ | $R_9$ | $R_{10}$ | $R_{11}$ |
| (52) | (79) | H | H | H | H | $CH_3$ | $CH_3$ | $COOCH_3$ | H | H | $COOCH_3$ | H |
| (53) | (79) | H | H | H | H | $CH_3$ | $CH_3$ | COOH | H | H | COOH | H |

TABLE 2-2-continued

Polyester Having Bis-Azo Dye Skeleton

| | | | | | | | | | | | | |
|---|---|---|---|---|---|---|---|---|---|---|---|---|
| (54) | (79) | H | H | H | H | $CH_3$ | $CH_3$ | $COOC_2H_5$ | H | H | $COOC_2H_5$ | H |
| (55) | (79) | H | H | H | H | $CH_3$ | $CH_3$ | $COOC_3H_7$(n) | H | H | $COOC_3H_7$(n) | H |
| (56) | (79) | H | H | H | H | $CH_3$ | $CH_3$ | $COOC_3H_7$(i) | H | H | $COOC_3H_7$(i) | H |
| (57) | (79) | H | H | H | H | $CH_3$ | $CH_3$ | $CONH_2$ | H | H | $CONH_2$ | H |
| (58) | (79) | H | H | H | H | $CH_3$ | $CH_3$ | $CONHCH_3$ | H | H | $CONHCH_3$ | H |
| (59) | (79) | H | H | H | H | $CH_3$ | $CH_3$ | $CONHC_2H_5$ | H | H | $CONHC_2H_5$ | H |
| (60) | (79) | H | H | H | H | $CH_3$ | $CH_3$ | $CONHC_3H_7$(n) | H | H | $CONHC_3H_7$(n) | H |
| (61) | (79) | H | H | H | H | $CH_3$ | $CH_3$ | $CON(C_2H_5)_2$ | H | H | $CON(C_2H_5)_2$ | H |
| (62) | (79) | H | H | H | H | $CH_3$ | $CH_3$ | $COOCH_3$ | H | H | H | H |
| (63) | (79) | H | H | H | H | $CH_3$ | $CH_3$ | H | $COOCH_3$ | H | H | H |
| (64) | (79) | H | H | H | H | $CH_3$ | $CH_3$ | H | H | $COOCH_3$ | H | H |
| (65) | (79) | H | H | H | H | $CH_3$ | $CH_3$ | H | $COOCH_3$ | H | $COOCH_3$ | H |
| (66) | (81) | H | H | H | H | $CH_3$ | $CH_3$ | $COOCH_3$ | H | H | $COOCH_3$ | H |
| (67) | (82) | H | H | H | H | $CH_3$ | $CH_3$ | $COOCH_3$ | H | H | $COOCH_3$ | H |

| Compound No. | Substitution position of $L_1$ in formulae (79) to (82) and structure of $L_1$ | | | | | Resin |
|---|---|---|---|---|---|---|
| | 2-position | 3-position | 4-position | 5-position | 6-position | |
| (52) | H | H | $-NH-C(=O)-*$ | H | H | (A) |
| (53) | H | H | $-C_2H_5O-C(=O)-*$ | H | H | (D) |
| (54) | H | H | $-C_2H_5O-C(=O)-*$ | H | H | (D) |
| (55) | H | H | $-C_2H_5O-C(=O)-*$ | H | H | (D) |
| (56) | H | H | $-C_2H_5O-C(=O)-*$ | H | H | (D) |
| (57) | H | H | $-C_2H_5O-C(=O)-*$ | H | H | (D) |
| (58) | H | H | $-C_2H_5O-C(=O)-*$ | H | H | (D) |
| (59) | H | H | $-C_2H_5O-C(=O)-*$ | H | H | (D) |
| (60) | H | H | $-C_2H_5O-C(=O)-*$ | H | H | (D) |
| (61) | H | H | $-C_2H_5O-C(=O)-*$ | H | H | (D) |
| (62) | H | H | $-C_2H_5O-C(=O)-*$ | H | H | (D) |
| (63) | H | H | $-C_2H_5O-C(=O)-*$ | H | H | (D) |
| (64) | H | H | $-C_2H_5O-C(=O)-*$ | H | H | (D) |
| (65) | H | H | $-C_2H_5O-C(=O)-*$ | H | H | (D) |

TABLE 2-2-continued

| Polyester Having Bis-Azo Dye Skeleton | | | | | | |
|---|---|---|---|---|---|---|
| (66) | H | H | $-C_2H_5O-\overset{O}{\overset{\|\|}{C}}-*$ | H | H | (D) |
| (67) | H | H | $-C_2H_5O-\overset{O}{\overset{\|\|}{C}}-*$ | H | H | (D) |

In Tables 2-1 and 2-2, the term "-position" refers to the substitution position in the formula (79), (80), (81), or (82) relative to the hydrazo group. The position of a substituent other than a hydrogen atom corresponds to the position of $L_1$ (for example, in the case of the polyester (35) having a bisazo skeleton, $L_1$ is located at a 4-position). Ph denotes an unsubstituted phenyl group. (n) and (i) denote that the corresponding alkyl group is linear and branched, respectively. "*" denotes a linkage between the linking group $L_1$ and the polyester resin. The formulae (79) to (82) in the column of the general formula have the following structures.

[Chem. 13]

Formula (79)

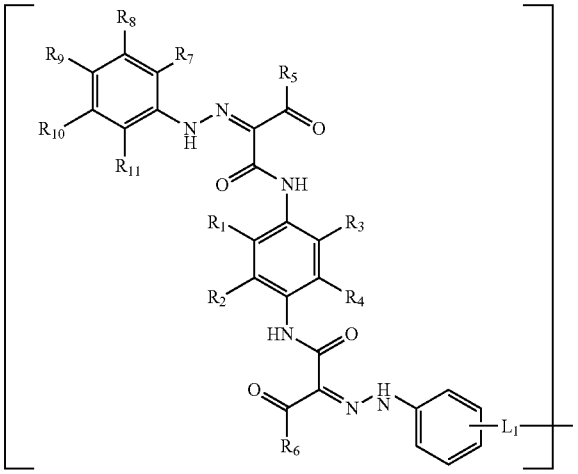

Formula (80)

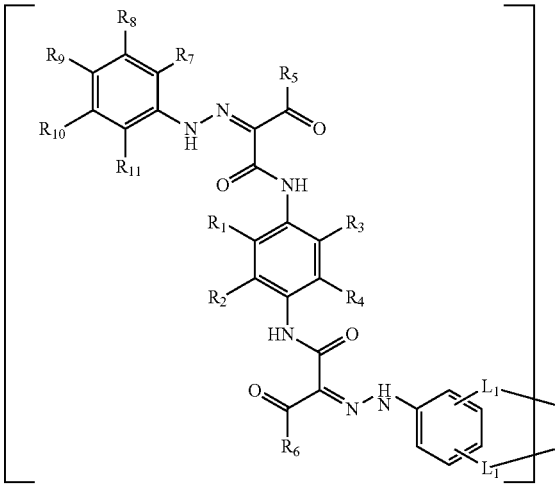

-continued

Formula (81)

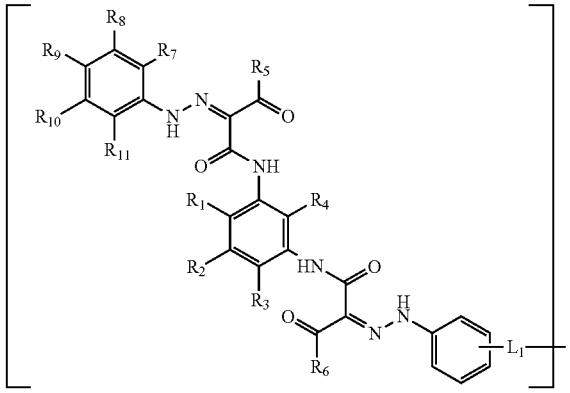

Formula (82)

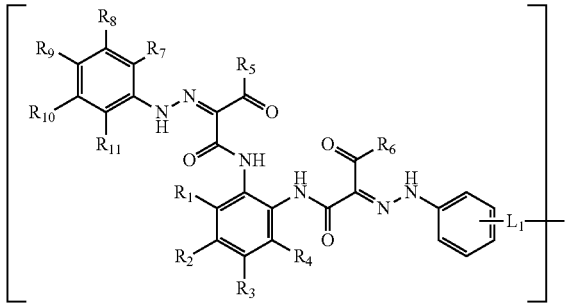

Compounds having azo dye skeletons represented by the following formula (83) and (84) were prepared by the method described above. The amidation between an amino group of these compounds and a carboxy group of the resin (A) yielded comparative compounds (83) and (84).

[Chem. 14]

Formula (83)

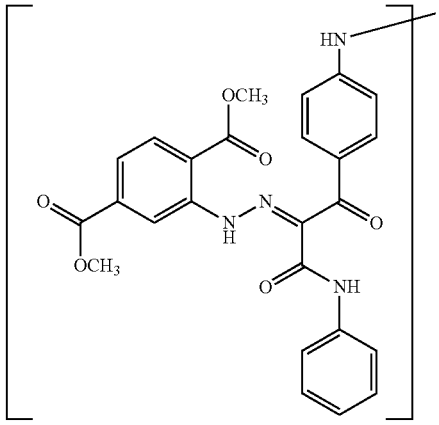

-continued

Formula (84)

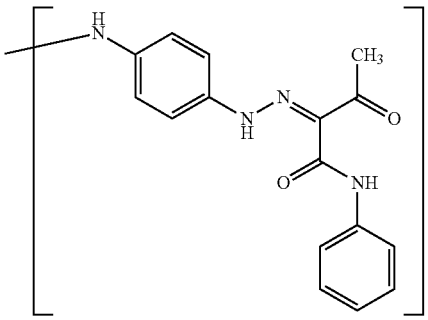

In a process for manufacturing toner by a suspension polymerization method, a pigment dispersion containing a pigment and a polyester having a bisazo dye skeleton was prepared as described below.

Preparation Example 1 of Pigment Dispersion 18.0 parts of an azo pigment having the formula (8), 5.4 parts of the polyester (35) having a bisazo dye skeleton, 180 parts of a water-insoluble solvent styrene, and 130 parts of glass beads (having a diameter of 1 mm) were mixed in an attritor [manufactured by Nippon Coke & Engineering Co., Ltd.] for three hours and were passed through a mesh filter to yield a pigment dispersion (a).

Preparation Example 2 of Pigment Dispersion

Pigment dispersions (b) to (ag) were prepared in the same manner as Preparation Example 1 of Pigment Dispersion except that the polyester (35) having a bisazo dye skeleton was replaced with the polyesters (36) to (67) having a bisazo dye skeleton, respectively.

Preparation Example 3 of Pigment Dispersion

Pigment dispersions (ah) and (ai) were prepared in the same manner as Preparation Example 1 of Pigment Dispersion except that the pigment having the formula (8) was replaced with the pigments having the following formulae (85) and (86), respectively.

[Chem. 15]

Formula (85)

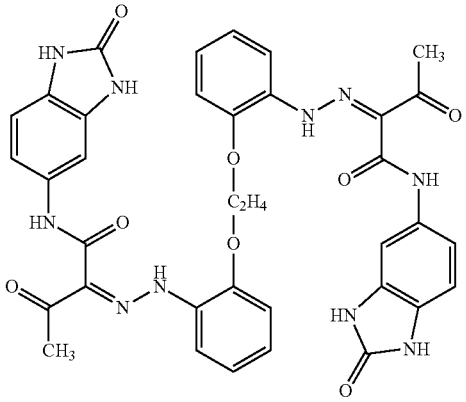

-continued

Formula (86)

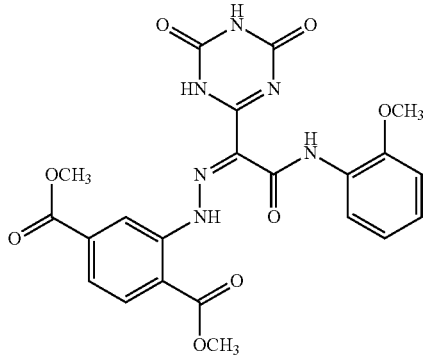

Reference pigment dispersions and comparative pigment dispersions were prepared by the following method. Preparation Example 1 of Reference Pigment Dispersion A reference pigment dispersion (aj) was prepared in the same manner as Preparation Example 1 of Pigment Dispersion except that the polyester (35) having a bisazo dye skeleton was not used.

Preparation Example 2 of Reference Pigment Dispersion

Reference pigment dispersions (ak) and (al) were prepared in the same manner as Preparation Example 3 of Pigment Dispersion except that the polyester (35) having a bisazo dye skeleton was not used.

Preparation Example 1 of Comparative Pigment Dispersion

Comparative pigment dispersions (am) to (ao) were prepared in the same manner as Preparation Example 1 of Pigment Dispersion except that the polyester (35) having a bisazo dye skeleton was replaced with a polymer dispersant Solsperse 24000SC (registered trademark) [manufactured by Lubrizol Corp.] described in PTL 3 and the comparative compounds (83) and (84), respectively.

The pigment dispersions were evaluated by the following method.

Evaluation of Viscosity of Pigment Dispersion

The viscosities of the pigment dispersions (a) to (ao) were measured with a viscoelasticity measuring apparatus Physica MCR300 [manufactured by Anton Paar GmbH, with a cone-plate jig: 75 mm in diameter, one degree] at a shear rate of 10 s-1 and were evaluated in accordance with the following criteria.

A: The viscosity was less than 500 mPa·s.

B: The viscosity was 500 mPa·s or more and less than 1000 mPa·s.

C: The viscosity was 1000 mPa·s or more and less than 2000 mPa·s.

D: The viscosity was 2000 mPa·s or more.

A viscosity of less than 1000 mPa·s was considered to indicate satisfactory pigment dispersibility and sufficiently low viscosity of the pigment dispersion.

A toner was manufactured by a suspension polymerization method as described below. Toner Production Example 1

710 parts of ion-exchanged water and 450 parts of 0.1 mol/1 aqueous $Na_3PO_4$ in a 2-L four-neck flask equipped with a high-speed agitator T.K. Homomixer [manufactured by Primix Corp.] were heated to 60° C. at a number of revolutions of 12000 rpm. 68 parts of 1.0 mol/1 aqueous $CaCl_2$ was slowly added to the resulting mixture to prepare an aqueous medium containing a minute poorly water-soluble dispersion stabilizer $Ca_3(PO_4)_2$. The following components were heated to 60° C. and were homogeneously dissolved or dispersed with a high-speed agitator T.K. Homomixer [manufactured by Primix Corp.] at 5000 rpm.

Pigment dispersion (a): 132 parts

Styrene monomer: 46 parts n-butyl acrylate monomer: 34 parts

Polar resin: 10 parts

[Saturated polyester resin (terephthalic acid-propylene oxide modified bisphenol A, acid value: 15 mgKOH/g, peak molecular weight: 6000)]

Ester wax: 25 parts (Temperature of maximum endothermic peak as determined by DSC: 70° C., Mn: 704)

Aluminum salicylate compound: 2 parts (manufactured by Orient Chemical Industries Co., Ltd., trade name: Bontron E-88)

Divinylbenzene monomer: 0.1 parts 10 parts of a polymerization initiator 2,2'-azobis(2,4-dimethylvaleronitrile) was added to the resulting mixture. The mixture was then added to the aqueous medium. Particles were formed at a number of revolutions of 12000 rpm for 15 minutes. The high-speed agitator was replaced with an agitator having impeller blades. Polymerization was performed at 60° C. for five hours and at 80° C. for eight hours. After the completion of the polymerization reaction, the residual monomers were removed at 80° C. under reduced pressure. The resulting product was cooled to 30° C., yielding a dispersion liquid of fine polymer particles.

A diluted hydrochloric acid was added to the dispersion liquid of fine polymer particles in a washing vessel while stirring. The dispersion liquid was stirred at pH 1.5 for two hours. A compound of phosphoric acid and calcium containing $Ca_3(PO_4)_2$ was dissolved in the dispersion liquid. The solid of the dispersion liquid was filtered out to yield fine polymer particles. The fine polymer particles were again dispersed in water. The solid of the dispersion liquid was filtered out. Redispersion of the fine polymer particles in water and solid-liquid separation were repeatedly performed until the compound of phosphoric acid and calcium containing $Ca_3(PO_4)_2$ was sufficiently removed. After the final solid-liquid separation, fine polymer particles were sufficiently dried in a dryer to yield toner particles.

100 parts of the toner particles were dry-blended with 1.0 part of a hydrophobic silica fine powder surface-treated with hexamethyldisilazane (the number average particle size of primary particles: 7 nm), 0.15 parts of a rutile titanium oxide fine powder (the number average particle size of primary particles: 45 nm), and 0.5 parts of a rutile titanium oxide fine powder (the number average particle size of primary particles: 200 nm) in a Henschel mixer [manufactured by Nippon Coke & Engineering Co., Ltd.] for five minutes to prepare a toner (1).

Toner Production Example 2

Toners (2) to (33) were prepared in the same manner as in Toner Production Example 1 except that the pigment dispersion (a) was replaced with pigment dispersions (b) to (ag), respectively.

Toner Production Example 3

Toners (34) and (35) were prepared in the same manner as in Toner Production Example 1 except that the pigment dispersion (a) was replaced with pigment dispersions (ah) and (ai), respectively.

A toner was manufactured by a suspension granulation method as described below.

Toner Production Example 4

180 parts of ethyl acetate, 12 parts of a pigment having the formula (8), 2.4 parts of the polyester (35) having a bisazo dye skeleton, and 130 parts of glass beads (diameter 1 mm) were mixed and dispersed for three hours with an attritor [manufactured by Nippon Coke & Engineering Co., Ltd.]. The resulting mixture was passed through a mesh filter to yield a pigment dispersion (A).

The following components were dispersed in a ball mill for 24 hours to prepare 200 parts of a toner composition liquid mixture.

Pigment dispersion (A): 96.0 parts

Polar resin: 85.0 parts

[Saturated polyester resin (a polycondensate of propylene oxide modified bisphenol A and phthalic acid, Tg: 75.9° C., Mw: 11000, Mn: 4200, acid value: 11 mgKOH/g)]

Hydrocarbon wax: 9.0 parts (Fischer-Tropsch wax, the temperature of a maximum endothermic peak as determined by DSC: 80° C., Mw: 750)

Aluminum salicylate compound: 2 parts (Bontron E-88, manufactured by Orient Chemical Industries Co., Ltd.)

Ethyl acetate (solvent): 10.0 parts

The following components were dispersed in a ball mill for 24 hours to dissolve carboxymethylcellulose, thereby yielding an aqueous medium.

Calcium carbonate (coated with an acrylic acid copolymer): 20.0 parts

Carboxymethylcellulose: 0.5 parts (Cellogen BS-H, manufactured by Dai-ichi Kogyo Seiyaku Co., Ltd.)

Ion-exchanged water: 99.5 parts 1000 parts of the toner composition liquid mixture was mixed with 1200 parts of the aqueous medium in a high-speed agitator T.K. Homomixer [manufactured by Primix Corp.] at 25° C. for one minute while rotating impellers were rotated at a peripheral speed of 20 m/s to prepare a suspension.

2200 parts of the suspension was stirred using a Fullzone impeller [manufactured by Kobelco Eco-Solutions Co., Ltd.] at a peripheral speed of 45 m/min at a liquid temperature of 40° C. A gas phase over the surface of the suspension was discharged with a blower to start solvent removal. 15 minutes after the start of solvent removal, 75 parts of 1% aqueous ammonia was added to the suspension as an ionic substance. One hour after the start of solvent removal, 25 parts of the aqueous ammonia was added to the suspension. Two hours after the start of solvent removal, 25 parts of the aqueous ammonia was added to the suspension. Finally, three hours after the start of solvent removal, 25 parts of the aqueous ammonia was added to the suspension. The total amount of aqueous ammonia was 150 parts. The suspension was maintained at a temperature of 40° C. for 17 hours from the start of solvent removal to remove the solvent (ethyl acetate), yielding a toner dispersion liquid.

80 parts of 10 mol/1 hydrochloric acid was added to 300 parts of the toner dispersion liquid prepared in the solvent removal process. The toner dispersion liquid was neutralized with 0.1 mol/1 aqueous sodium hydroxide and was washed four times with ion-exchanged water using suction filtration, yielding a toner cake. The toner cake was dried with a vacuum dryer and was passed through a sieve having an opening of 45 μm, yielding toner particles. A toner (36) was then manufactured in the same manner as in Toner Production Example 1.

Toner Production Example 5

Toners (37) to (68) were manufactured in the same manner as in Toner Production Example 4 except that the polyester (35) having a bisazo dye skeleton was replaced with (36) to (67), respectively.

Toner Production Example 6

Toners (69) and (70) were manufactured in the same manner as in Toner Production Example 4 except that the pigment having the formula (8) was replaced with the pigments having the following formulae (85) and (86), respectively.

Reference toners for evaluation were manufactured by the following methods.

Reference Toner Production Example 1

A reference toner (71) was manufactured in the same manner as in Toner Production Example 1 except that the polyester (35) having a bisazo dye skeleton was not used.

Reference Toner Production Example 2

Reference toners (72) and (73) were manufactured in the same manner as in Toner Production Example 3 except that the polyester (35) having a bisazo dye skeleton was not used.

Comparative Toner Production Example 1

Comparative toners (74) to (76) were manufactured in the same manner as in Toner Production Example 1 except that the polyester (35) having a bisazo dye skeleton was replaced with Solsperse 24000SC (registered trademark) [manufactured by Lubrizol Corp.], (83), and (84), respectively.

Reference Toner Production Example 3

A reference toner (77) was manufactured in the same manner as in Toner Production Example 4 except that the polyester (35) having a bisazo dye skeleton was not used.

Reference Toner Production Example 4

Reference toners (78) and (79) were manufactured in the same manner as in Toner Production Example 6 except that the polyester (35) having a bisazo dye skeleton was not used.

Comparative Toner Production Example 2

Comparative toners (80) to (82) were manufactured in the same manner as in Toner Production Example 4 except that the polyester (35) having a bisazo dye skeleton was replaced with Solsperse 24000SC (registered trademark) [manufactured by Lubrizol Corp.], (85), and (86), respectively.

The toners (1) to (70), the reference toners (71) to (73) and (77) to (79), and the comparative toners (74) to (76) and (80) to (82) were evaluated by the following method.

Evaluation of Toner Color Tone

Image samples were output using the toners (1) to (82). The image characteristics described below were compared. The image characteristics were compared with respect to paper-feed durability using a modified printer of LBP-5300 [manufactured by CANON KABUSHIKI KAISHA] as an image-forming apparatus. The modification included replacement of a developing blade in a process cartridge with a SUS blade having a thickness of 8 μm. In addition, a blade bias of −200 V could be applied relative to a developing bias applied to a developing roller, which carried toner.

A solid image was formed on a transfer paper sheet (75 g/m$^2$ paper sheet) at a toner loading of 0.5 mg/cm normal temperature and normal humidity (N/N (23.5° C. and 60% RH)). On the basis of the L*a*b* color system defined by International Commission on Illumination (CIE), L* and C* of the image were measured with a reflection densitometer Spectrolino (manufactured by GretagMacbeth) using a light source of D50 at a visual field of two degrees. The toner color tone was evaluated as an improvement in C* at L*=95.5.

An improvement in C* of the image for the toners (1) to (33) was based on C* of the image for the reference toner (71). An improvement in C* of the image for the toner (34) was based on C* of the image for the reference toner (72). An improvement in C* of the image for the toner (35) was based on C* of the image for the reference toner (73).

An improvement in C* of the image for the toners (36) to (68) was based on C* of the image for the reference toner (77). An improvement in C* of the image for the toner (69) was based on C* of the image for the reference toner (78). An improvement in C* of the image for the toner (70) was based on C* of the image for the reference toner (79).

The evaluation criteria for an improvement in C* are as follows:

A: An improvement in C* was 5% or more.

B: An improvement in C* was 1% or more and less than 5%.

C: An improvement in C* was less than 1%.

D: C* decreased.

An improvement in C* of 1% or more was considered to indicate a satisfactory color tone.

Table 3 shows the color tone evaluation results for the toners manufactured by the suspension polymerization method. Table 4 shows the color tone evaluation results for the toners manufactured by the suspension granulation method.

Evaluation of Comparative Toner Color Tone

The comparative toners (74) to (76) and (80) to (82) were evaluated by the same method.

An improvement in C* of the image for the comparative toners (74) to (76) was based on C* of the image for the reference toner (71).

An improvement in C* of the image for the comparative toners (80) to (82) was based on C* of the image for the reference toner (77).

Table 3 shows the color tone evaluation results for the reference toners and the comparative toners manufactured by the suspension polymerization method. Table 4 shows the color tone evaluation results for the reference toners and the comparative toners manufactured by the suspension granulation method.

TABLE 3

Evaluation Results for Suspension Polymerization Toner

| Toner No. | Pigment dispersion symbol | Polyester No. | Pigment | Viscosity evaluation | Coloring evaluation |
|---|---|---|---|---|---|
| (1) | (a) | (35) | (8) | A(195) | A(8) |
| (2) | (b) | (36) | (8) | A(256) | A(7) |
| (3) | (c) | (37) | (8) | A(245) | A(8) |
| (4) | (d) | (38) | (8) | A(158) | A(6) |
| (5) | (e) | (39) | (8) | A(275) | A(7) |
| (6) | (f) | (40) | (8) | A(151) | A(9) |
| (7) | (g) | (41) | (8) | A(201) | A(6) |
| (8) | (h) | (42) | (8) | A(312) | A(8) |
| (9) | (i) | (43) | (8) | A(219) | A(7) |
| (10) | (j) | (44) | (8) | A(297) | A(8) |
| (11) | (k) | (45) | (8) | B(880) | B(3) |
| (12) | (l) | (46) | (8) | A(420) | A(6) |
| (13) | (m) | (47) | (8) | B(660) | B(3) |
| (14) | (n) | (48) | (8) | A(320) | A(9) |
| (15) | (o) | (49) | (8) | B(729) | B(4) |
| (16) | (p) | (50) | (8) | A(304) | A(7) |
| (17) | (q) | (51) | (8) | A(249) | A(7) |
| (18) | (r) | (52) | (8) | A(355) | A(8) |
| (19) | (s) | (53) | (8) | A(225) | A(8) |
| (20) | (t) | (54) | (8) | B(680) | B(3) |
| (21) | (u) | (55) | (8) | B(524) | B(4) |
| (22) | (v) | (56) | (8) | B(598) | B(4) |
| (23) | (w) | (57) | (8) | B(645) | B(3) |
| (24) | (x) | (58) | (8) | B(697) | B(2) |
| (25) | (y) | (59) | (8) | B(727) | B(4) |
| (26) | (z) | (60) | (8) | B(809) | B(3) |
| (27) | (aa) | (61) | (8) | B(603) | B(3) |
| (28) | (ab) | (62) | (8) | A(213) | A(9) |
| (29) | (ac) | (63) | (8) | B(620) | B(4) |
| (30) | (ad) | (64) | (8) | B(811) | B(3) |
| (31) | (ae) | (65) | (8) | B(950) | B(3) |
| (32) | (af) | (66) | (8) | A(238) | A(8) |
| (33) | (ag) | (67) | (8) | A(119) | A(8) |
| (34) | (ah) | (35) | (85) | B(535) | B(3) |
| (35) | (ai) | (35) | (86) | B(712) | B(2) |
| (71) | (aj) | None | (8) | D(2221) | — |
| (72) | (ak) | None | (85) | C(1850) | — |
| (73) | (al) | None | (86) | C(1622) | — |
| (74) | (am) | Solsperse24000SC | (8) | D(2183) | D(−2) |
| (75) | (an) | Comparative compound (83) | (8) | D(12500) | D(−3) |
| (76) | (ao) | Comparative compound (84) | (8) | D(2071) | D(−5) |

TABLE 4

Evaluation Results for Suspension Granulation Toner

| Toner No. | Compound No. | Pigment | Coloring evaluation |
|---|---|---|---|
| (36) | (35) | (8) | A(7) |
| (37) | (36) | (8) | B(3) |
| (38) | (37) | (8) | A(6) |
| (39) | (38) | (8) | A(7) |
| (40) | (39) | (8) | A(8) |
| (41) | (40) | (8) | A(9) |
| (42) | (41) | (8) | B(3) |
| (43) | (42) | (8) | B(4) |
| (44) | (43) | (8) | A(7) |
| (45) | (44) | (8) | A(5) |
| (46) | (45) | (8) | B(4) |
| (47) | (46) | (8) | A(9) |
| (48) | (47) | (8) | B(2) |
| (49) | (48) | (8) | A(6) |
| (50) | (49) | (8) | B(3) |
| (51) | (50) | (8) | A(8) |
| (52) | (51) | (8) | A(5) |
| (53) | (52) | (8) | A(7) |
| (54) | (53) | (8) | B(4) |
| (55) | (54) | (8) | B(2) |
| (56) | (55) | (8) | B(3) |
| (57) | (56) | (8) | B(2) |
| (58) | (57) | (8) | B(3) |
| (59) | (58) | (8) | B(3) |
| (60) | (59) | (8) | B(4) |
| (61) | (60) | (8) | B(2) |
| (62) | (61) | (8) | A(7) |
| (63) | (62) | (8) | A(8) |
| (64) | (63) | (8) | B(3) |
| (65) | (64) | (8) | B(4) |
| (66) | (65) | (8) | B(3) |
| (67) | (66) | (8) | A(6) |
| (68) | (67) | (8) | A(8) |
| (69) | (35) | (85) | B(3) |
| (70) | (35) | (86) | B(2) |
| (77) | None | (8) | — |
| (78) | None | (85) | — |
| (79) | None | (86) | — |
| (80) | Solsperse24000SC | (8) | D(−2) |
| (81) | Comparative compound (83) | (8) | D(−5) |
| (82) | Comparative compound (84) | (8) | D(−1) |

Table 3 shows that use of the polyester having a bisazo dye skeleton allows the azo pigment to be well dispersed in the binder resin, thereby providing a toner having a satisfactory color tone. Use of the polyester having a bisazo dye skeleton can also prevent an increase in the viscosity of the pigment dispersion. Thus, a toner having satisfactory pigment dispersibility can be manufactured by a process using the polymerization method. Table 4 shows that the azo pigment is well dispersed in the binder resin also in the case of the suspension granulation method. Thus, the resulting toner has a satisfactory color tone.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-246928, filed Nov. 10, 2011, which is hereby incorporated by reference herein in its entirety.

The invention claimed is:

1. A toner, comprising toner particles each containing a binder resin and a colorant, wherein each of the toner particles contains a compound having a polyester moiety and a bisazo structure moiety represented by the following formula (1) or (2), and the colorant is an azo pigment:

[Chem. 1]

Formula (1)

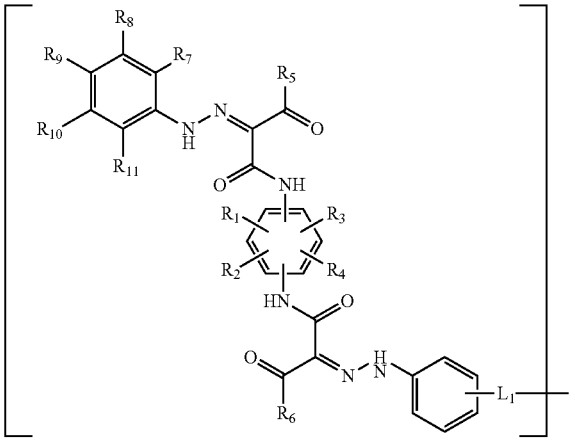

Formula (2)

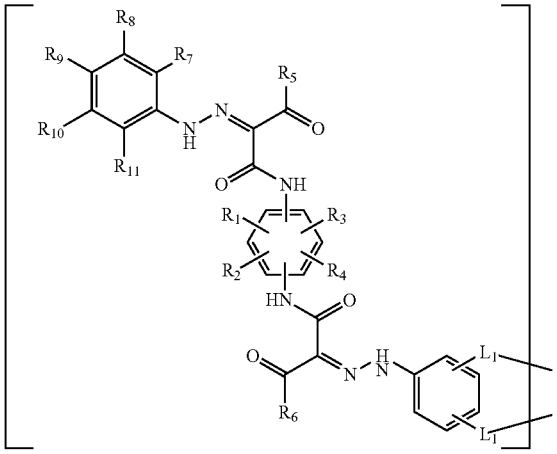

wherein $R_1$ to $R_4$ independently denote a hydrogen atom or a halogen atom, $R_5$ and $R_6$ independently denote an alkyl group having 1 to 6 carbon atoms or a phenyl group, $R_7$ to $R_{11}$ independently denote a hydrogen atom, a $COOR_{12}$ group, or a $CONR_{13}R_{14}$ group, provided that at least one of $R_7$ to $R_{11}$ denotes the $COOR_{12}$ group or the $CONR_{13}R_{14}$ group, $R_{12}$ to $R_{14}$ independently denote a hydrogen atom or an alkyl group having 1 to 3 carbon atoms, and $L_1$ denotes a divalent linking group to be bonded to the polyester moiety.

2. The toner according to claim 1, wherein $R_5$ and $R_6$ denote a methyl group.

3. The toner according to claim 1, wherein $R_7$ and $R_{10}$ denote $COOR_{12}$, and $R_8$, $R_9$, and $R_{11}$ denote a hydrogen atom.

4. The toner according to claim 1, wherein $L_1$ denotes a linking group having a carboxylate bond, a carboxylic acid amide bond, or a sulfonate bond.

5. The toner according to claim 1, wherein the compound has the bisazo structure moiety having the formula (1), and the bisazo structure moiety having the formula (1) has the following formula (7)

[Chem. 2]

Formula (7)

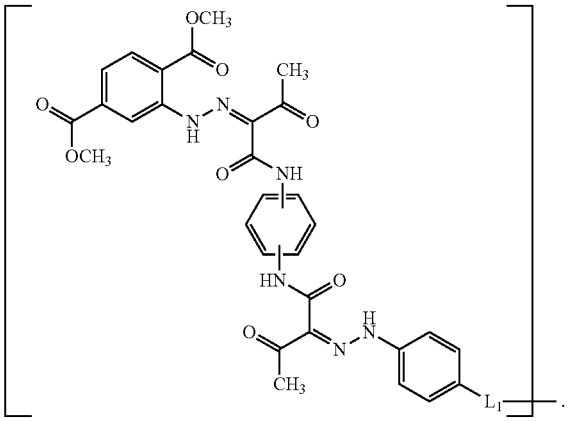

6. The toner according to claim 1, wherein the azo pigment is an acetoacetanilide pigment.

7. The toner according to claim 6, wherein the acetoacetanilide pigment has the following formula (8)

[Chem. 9]

Formula (8)

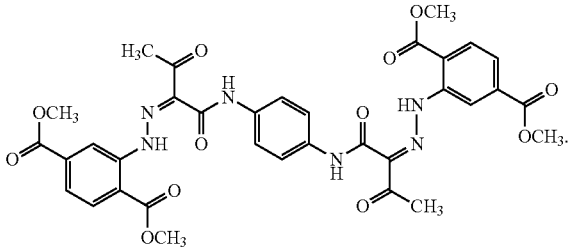

8. A method for manufacturing toner particles, comprising: dispersing a polymerizable monomer composition containing a pigment composition and a polymerizable monomer in an aqueous medium, forming particles of the polymerizable monomer composition, and polymerizing the polymerizable monomer in the particles to manufacture toner particles, wherein the pigment composition contains an azo pigment and a compound having a polyester moiety and a bisazo structure moiety represented by the following formula (1) or (2):

[Chem. 1]

Formula (1)

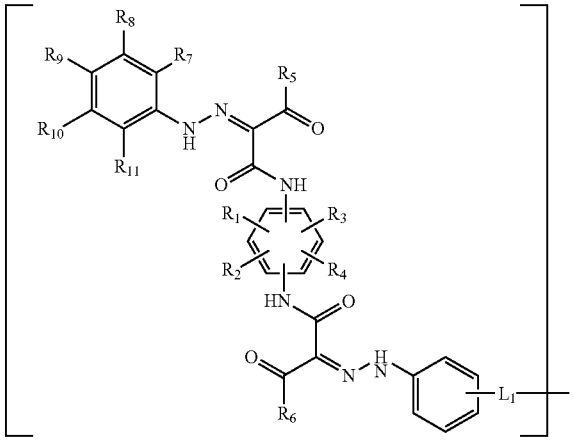

-continued

Formula (2)

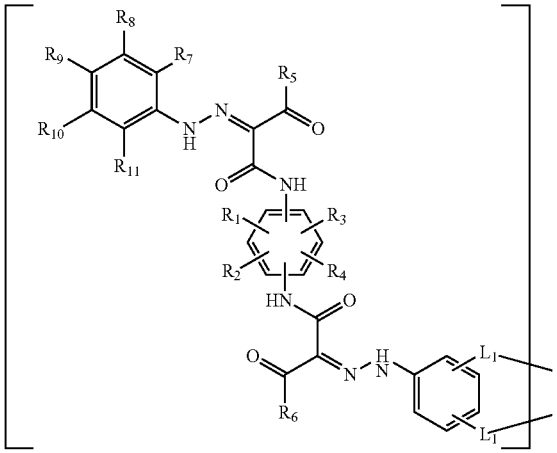

wherein $R_1$ to $R_4$ independently denote a hydrogen atom or a halogen atom, $R_5$ and $R_6$ independently denote an alkyl group having 1 to 6 carbon atoms or a phenyl group, $R_7$ to $R_{11}$ independently denote a hydrogen atom, a $COOR_{12}$ group, or a $CONR_{13}R_{14}$ group, provided that at least one of $R_7$ to $R_{11}$ denotes the $COOR_{12}$ group or the $CONR_{13}R_{14}$ group, $R_{12}$ to $R_{14}$ independently denote a hydrogen atom or an alkyl group having 1 to 3 carbon atoms, and $L_1$ denotes a divalent linking group to be bonded to the polyester moiety.

9. A method for manufacturing toner particles, comprising: dispersing a resin solution containing a pigment composition, a binder resin, and a solvent in an aqueous medium, forming particles from the resin solution to produce a suspension, and removing the solvent from the suspension to manufacture toner particles, wherein the pigment composition contains an azo pigment and a compound having a polyester moiety and a bisazo structure moiety represented by the following formula (1) or (2):

[Chem. 1]

Formula (1)

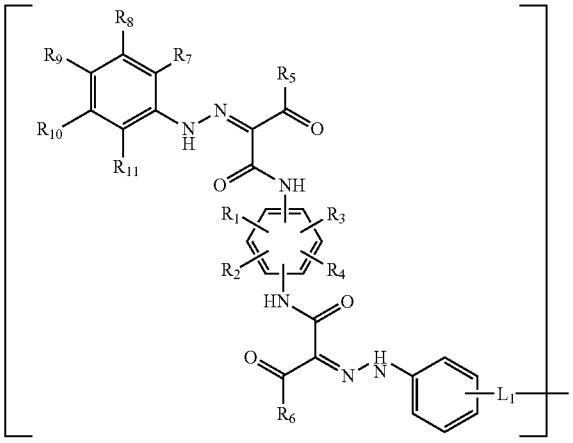

-continued

Formula (2)

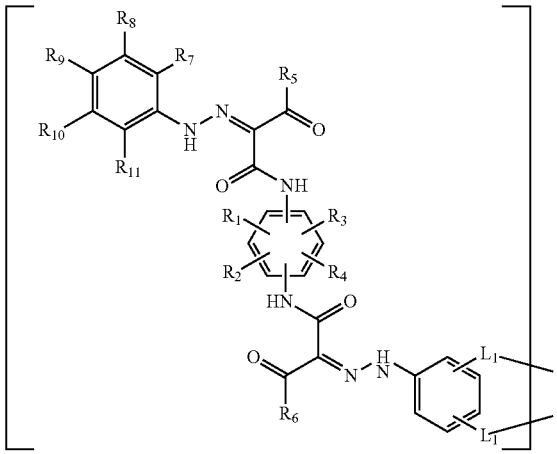

wherein $R_1$ to $R_4$ independently denote a hydrogen atom or a halogen atom, $R_5$ and $R_6$ independently denote an alkyl group having 1 to 6 carbon atoms or a phenyl group, $R_7$ to $R_{11}$ independently denote a hydrogen atom, a $COOR_{12}$ group, or a $CONR_{13}R_{14}$ group, provided that at least one of $R_7$ to $R_{11}$ denotes the $COOR_{12}$ group or the $CONR_{13}R_{14}$ group, $R_{12}$ to $R_{14}$ independently denote a hydrogen atom or an alkyl group having 1 to 3 carbon atoms, and $L_1$ denotes a divalent linking group to be bonded to the polyester moiety.

* * * * *